US009782645B2

(12) United States Patent
Dolezel

(10) Patent No.: US 9,782,645 B2
(45) Date of Patent: Oct. 10, 2017

(54) GOLF CLUB HEAD

(71) Applicant: DUNLOP SPORTS CO. LTD., Kobe-shi, Hyogo (JP)

(72) Inventor: Keith Dolezel, Covina, CA (US)

(73) Assignee: DUNLOP SPORTS CO. LTD., Kobe (JP)

( * ) Notice: Subject to any disclaimer, the term of this patent is extended or adjusted under 35 U.S.C. 154(b) by 0 days.

(21) Appl. No.: 14/934,903

(22) Filed: Nov. 6, 2015

(65) Prior Publication Data

US 2016/0129321 A1 May 12, 2016

Related U.S. Application Data

(63) Continuation-in-part of application No. 14/806,041, filed on Jul. 22, 2015.

(60) Provisional application No. 62/077,520, filed on Nov. 10, 2014.

(51) Int. Cl.
*A63B 53/04* (2015.01)

(52) U.S. Cl.
CPC .... *A63B 53/0487* (2013.01); *A63B 2053/042* (2013.01); *A63B 2053/0408* (2013.01); *A63B 2053/0416* (2013.01); *A63B 2053/0425* (2013.01); *A63B 2053/0441* (2013.01)

(58) Field of Classification Search
CPC ..... A63B 53/0487; A63B 53/007; A63B 53/065; A63B 2053/0408; A63B 2053/0425; A63B 2053/0429; A63B 2053/021; A63B 2053/027; A63B 2053/042
See application file for complete search history.

(56) References Cited

U.S. PATENT DOCUMENTS

| | | | | |
|---|---|---|---|---|
| 5,078,398 | A * | 1/1992 | Reed | A63B 53/0487 273/DIG. 14 |
| 5,405,136 | A | 4/1995 | Hardman | |
| 5,464,212 | A | 11/1995 | Cook | |
| 5,766,093 | A | 6/1998 | Rohrer | |
| 5,785,608 | A * | 7/1998 | Collins | A63B 53/02 473/294 |
| 5,921,871 | A | 7/1999 | Fisher | |
| 5,944,619 | A | 8/1999 | Cameron | |
| 6,200,229 | B1 * | 3/2001 | Grace | A63B 53/0487 473/324 |
| 6,302,807 | B1 | 10/2001 | Rohrer | |

(Continued)

OTHER PUBLICATIONS

Feb. 18, 2016 Office Action Issued in U.S. Appl. No. 14/806,041.

(Continued)

*Primary Examiner* — John E Simms, Jr.
(74) *Attorney, Agent, or Firm* — Oliff PLC

(57) ABSTRACT

A putter-type golf club head includes a main body. The main body includes a forward end, a rearward end opposite the forward end, a bottom portion, a top portion opposite the bottom portion, and a male-type hosel component defining a longitudinal axis that is forwardly canted relative to vertical. A face component is secured to the forward end of the main body. The face component includes a first element formed of a resilient material and a second element formed of a rigid material that is secured to the first element. A striking face generally defines a virtual striking face plane and is at least partially formed by the face component.

14 Claims, 25 Drawing Sheets

(56) References Cited

U.S. PATENT DOCUMENTS

| | | | | |
|---|---|---|---|---|
| 6,375,583 | B1 | 4/2002 | Solheim | |
| 6,680,822 | B1 | 1/2004 | Lin et al. | |
| 6,951,518 | B2 | 10/2005 | Solheim et al. | |
| 7,175,540 | B2 | 2/2007 | Sano | |
| 7,455,599 | B2 | 11/2008 | Jones | |
| 7,648,424 | B2 | 1/2010 | Hinojosa | |
| 8,771,098 | B2 | 7/2014 | Hilton | |
| 8,834,285 | B2 | 9/2014 | Franklin et al. | |
| 8,900,071 | B2 * | 12/2014 | Kii | A63B 53/0487 473/332 |
| D730,462 | S | 5/2015 | Becktor et al. | |
| 2008/0020860 | A1 * | 1/2008 | Imamoto | A63B 53/047 473/332 |
| 2011/0319188 | A1 * | 12/2011 | Narita | A63B 53/0487 473/329 |
| 2012/0108357 | A1 | 5/2012 | Nakamura | |
| 2012/0149492 | A1 * | 6/2012 | Del Rosario | A63B 53/0487 473/340 |
| 2012/0184392 | A1 | 7/2012 | Narita et al. | |
| 2013/0005503 | A1 | 1/2013 | Kii | |
| 2013/0137533 | A1 * | 5/2013 | Franklin | A63B 53/04 473/349 |
| 2014/0194220 | A1 * | 7/2014 | Hocknell | A63B 53/04 473/329 |
| 2015/0343285 | A1 | 12/2015 | Franklin et al. | |

OTHER PUBLICATIONS

Nike Golf Method Converge M1-08 Putter. Information and images available at: <http://www.golfwrx.com/246795/full-nike-2015-equipment-line>, pp. 10-11. Oct. 1, 2014.

Nike Method Converge B1-01 Putter. Information and images available at: <http://www.golfwrx.com/246795/full-nike-2015-equipment-line>. Oct. 1, 2014.

Nike Method Converge S1-12 Putter. Information and images available at: <http://www.golfwrx.com/246795/full-nike-2015-equipment-line>. Oct. 1, 2014.

Cobra Golf Payday putter. Information and images available at: <http://valueguide.pga.com/detail-exec/brand/2678/product_type/206/model/44329/b/Cobra/p/Putter/m/Payday%20Mallet>. Nov. 26, 2007.

Cobra Golf Bobby Grace Cute Kid Putter. Information and images available at: <https://valueguide.pga.com/detail-exec/brand/2678/product_type/206/model/43637/b/Cobra/p/Putter/m/Bobby%20Grace%20The%20Cute%20Kid>. Nov. 26, 2007.

Jun. 20, 2017 Office Action issued in U.S. Appl. No. 15/290,736.

* cited by examiner

GOLF CLUB HEAD

CROSS-REFERENCE TO RELATED APPLICATIONS

This application claims the benefit under 35 U.S.C. §119(e) of U.S. Non-Provisional patent application Ser. No. 14/806,041, filed on Jul. 22, 2015, the subject matter of which is incorporated herein by reference in its entirety; and U.S. Provisional Patent Application Ser. No. 62/077,520, filed on Nov. 10, 2014, the subject matter of which is incorporated herein by reference in its entirety.

BACKGROUND

Putting is a critical aspect of success in the game of golf. Minor misjudgments in velocity and aim may spell the difference between success and failure. Slight misalignments in orientation may prove equally significant. Although the putting stroke is seemingly simplistic, minor deviations, e.g. in dynamic loft and/or height of the putter head at impact, from ideal conditions may have an outweighed effect on whether a putt is overshot, undershot, or just right. These variances are not well understood to the novice or recreational player and thus may lead to frustration and failure to progress. Thus, a need exists to counter the negative effects of minor misalignments of a putter-type golf club to reduce such frustration and promote engagement.

SUMMARY

In accordance with one or more embodiments, a putter-type golf club head is provided having a main body and a face component including a first element formed of a resilient material and a second element forward of the first element. The second element has a rigid material and is secured directly to the first element. The first element has a thickness that gradually increases toward a sole portion.

In accordance within one or more embodiments, a putter-type golf club head is provided having a main body having a front surface and a face component secured to the front surface of the main body. The face component includes a resilient body having a front surface, a rear surface opposite the front surface, a heel surface, and a toe surface. At least a portion of at least one of the heel surface and the toe surface is visually exposed. The resilient body defines a trapezoidal front-to-rear profile.

In accordance with one or more embodiments, a putter-type golf club head is provided comprising a striking face, a top surface, a rearward surface, a bottom surface having a beveled rear edge, a center of gravity having a depth, Dcg, and a club head depth Dch, such that Dcg/Dch is no less than 0.42.

In accordance with one or more embodiments, a putter-type golf club head is provided comprising a main body having a forward end, a rearward end opposite the forward end, a bottom portion, a top portion opposite the bottom portion, and a male-type hosel component defining a longitudinal axis that is forwardly canted relative to vertical. The club head further includes a face component secured to the forward end of the main body, the face component including a first element formed of a resilient material and a second element formed of a rigid material and secured to the first element. The club head further includes a striking face generally defining a virtual striking face plane and being at least partially formed by the face component.

In accordance with one or more embodiments, a putter-type golf club head that, when oriented in a reference position, comprises a main body having a front surface, a rear surface opposite the front surface, a bottom surface, a top surface opposite the bottom portion, and a flange extending forwardly from the front surface. The club head further includes a face component secured to the front surface of the main body such that the flange extends over the face component and forwardly of the face component by no less than 0.1 mm. The face component includes a first element formed of a resilient material and a second element formed of a rigid material and secured to the first element. The club head further includes a striking face that generally defines a virtual striking face plane and is at least partially formed by the face component.

In accordance with one or more embodiments, a putter-type golf club head that, when oriented in a reference position, comprises a striking face generally defining a virtual striking face plane, a top surface, a rearward surface, a bottom surface, and a bevel adjoining the bottom surface with the rearward surface, the bevel having a forward end and a rearward end. In a virtual vertical plane perpendicular to the virtual striking face plane and passing through a portion of the bevel, the club head includes a first thickness t1 located at the bevel forward end and a second thickness t2 located at the bevel rearward end such that t1−t2 is no less than 2.0 mm.

The various exemplary aspects described above may be implemented individually or in various combinations.

These and other features and advantages of the golf club head according to the disclosure in its various aspects, as provided by one or more of the various examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

The present disclosure, in one or more aspects thereof, is illustrated by way of example and not by way of limitation, in the figures of the accompanying drawings, where:

FIG. 23(*b*) is a cross-sectional view of the club head of FIG. 20 taken through plane A-A';

FIG. 25(*b*) is a top plan view of the golf club head of FIG. 25(*a*);

FIG. 25(*c*) is a heel side elevation view of the golf club head of FIG. 25(*a*);

FIG. 25(*d*) is a rear elevation view of the golf club head of FIG. 25(*a*);

FIG. 25(*e*) is a front elevation view of the golf club head of FIG. 25(*a*);

FIG. 26(*b*) is a heel side elevation view of the golf club head of FIG. 26(*a*);

FIG. 26(*c*) is a front elevation view of the golf club head of FIG. 26(*a*);

FIG. 26(*d*) is a top plan view of the golf club head of FIG. 26(*a*);

FIG. 26(*e*) is a rear elevation view of the golf club head of FIG. 26(*a*);

FIG. 26(*f*) is a bottom plan view of the golf club head of FIG. 26(*a*);

FIG. 27(*b*) is a heel side elevation view of the golf club head of FIG. 27(*a*);

FIG. 27(*c*) is a top plan view of the golf club head of FIG. 27(*a*);

FIG. 27(*d*) is a bottom plan view of the golf club head of FIG. 27(*a*);

FIG. 27(*e*) is a rear elevation view of the golf club head of FIG. 27(*a*);

FIG. 27(*f*) is a front elevation view of the golf club head of FIG. 27(*a*);

FIG. 27(*b*) is a heel side elevation view of the golf club head of FIG. 27(*a*);

FIG. 27(*c*) is a top plan view of the golf club head of FIG. 27(*a*);

FIG. 27(*d*) is a bottom plan view of the golf club head of FIG. 27(*a*);

FIG. 27(*e*) is a rear elevation view of the golf club head of FIG. 27(*a*);

FIG. 27(*f*) is a front elevation view of the golf club head of FIG. 27(*a*);

FIG. 28(*b*) is a top plan view of the golf club head of FIG. 28(*a*);

FIG. 28(*c*) is a bottom plan view of the golf club head of FIG. 28(*a*);

FIG. 28(*d*) is a heel side elevation view of the golf club head of FIG. 28(*a*);

FIG. 28(*e*) is a rear elevation view of the golf club head of FIG. 28(*a*);

FIG. 28(*f*) is a front elevation view of the golf club head of FIG. 28(*a*); and FIG. 28(*g*) is a front perspective view of the golf club head of FIG. 28(*a*).

DETAILED DESCRIPTION

Figure 1:
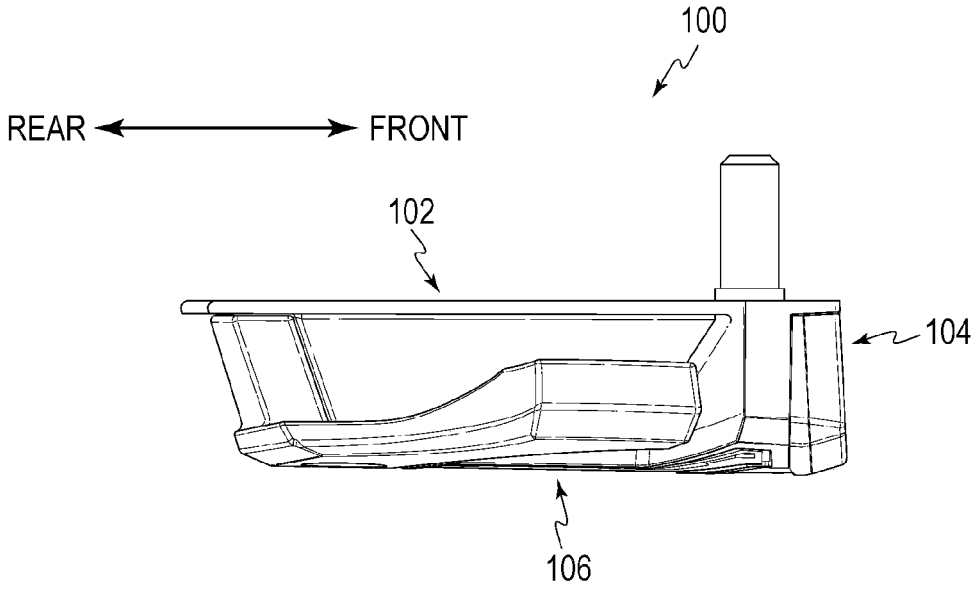
FIG. 1 is a toe-side elevation view of a golf club head, according to one embodiment.

As shown in FIGS. 1-8, in accordance with one embodiment, a putter-type golf club head 100 includes a body member 102, a face component 104, and a bottom portion 106. In some embodiments, the face component 104 is an aft-attached component affixed, preferably permanently, to the body member 102. Also, the bottom portion 106 may be aft-attached to the body member 102. This enables selectively positioning materials of different properties where they may be best suited.

The body member 102 may include a blade portion 108 (see FIG. 7) longitudinally extending in a heel-to-toe direction and a central elongate portion 110 extending rearward from the blade portion 108. The blade portion 108 and the central elongate portion 110, in combination, form a top surface 112, a bottom surface 114 (see e.g. FIG. 6), a rear surface 116 and a front surface 148.

For all purposes herein, the term "reference position" refers to an orientation of a club head relative to a virtual ground plane in which a sole portion of the club head rests on the virtual ground plane such that the club head is squared in a normal address position.

For all purposes herein, the term "soled position" refers to an orientation of a club head relative to a virtual ground plane in which a bottom portion, or sole portion, of the club head contacts and freely rests on the virtual ground plane. Unless otherwise noted, all dimensions and positional characteristics described herein with regard to a golf club head are intended to be measured or determined with the golf club head oriented in a soled position.

The body member top surface 112 may further include an alignment element 120. The alignment element may include a shallow groove for assisting the golfer to alignment the putter with a golf ball. In some embodiments, the alignment element 120 may comprise a first and second geometric feature, e.g. squares 120(*a*) and 120(*b*). The top surface 112 further includes a recess (not shown) receiving an aft-attached hosel component 124.

As discussed above, and as particularly shown in FIG. 2, the face component 104 may include a first insert 126 comprising a compressible element and a second insert 128 comprising a cap element in communication with the first insert 126. Specifically, the second insert 128 is forward of the first insert 126 and may form a portion of the exterior striking face 130 of the club head 100.

Figure 2:
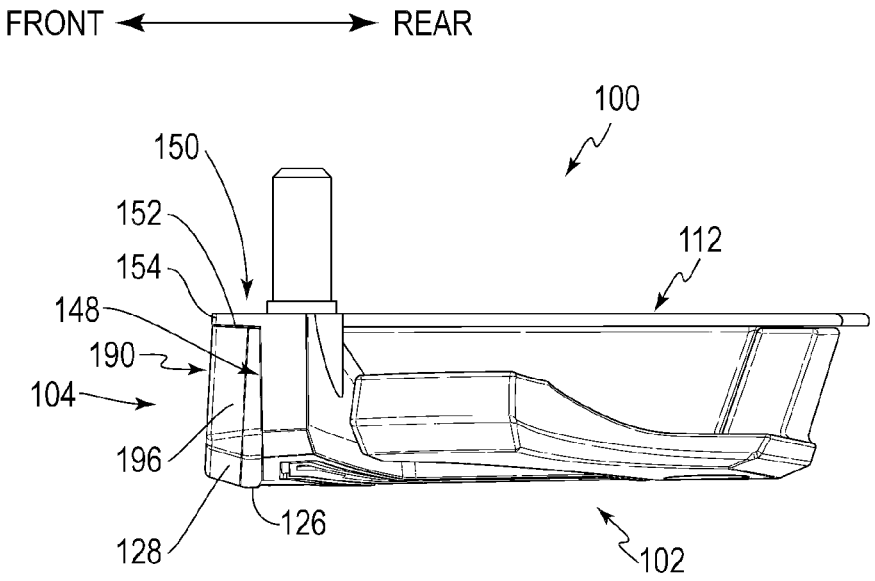
FIG. 2 is a heel-side elevation view of the golf club head of FIG. 1.

Referring to FIG. 2, the body member 102 includes a front portion including a near-vertical front surface 148. Preferably, the front surface 148 of the body member 102 forms a forward-leaning angle $\phi$ of 1° as projected in a vertical plane 170 perpendicular to the striking face 130 and relative to a vertical plane 172 perpendicular to the vertical plane 170 (see e.g. FIG. 13). A flange 150 projects forward from the front surface 148 (see e.g. FIG. 2). The flange 150 may further include a bottom surface 152, a front surface 154, which may form a portion of the striking face 130 of the club head 100, and a top surface that is preferably flush with and integral with the top surface 112 of the body member 102 of the club head 100. This configuration provides for removal of significant high density material from the front portion of the club head 100 and optional replacement with a lower density material, e.g. the face component 104. Specifically, the flange 150 ensures that the putter head 100 appears full-sized and continuous from a vertical position (i.e. the position of the golfer's eyes upon swinging a golf club including the embodied club head 100). Yet, the flange 150 provides a recessed region into which the face component 104 may be secured. Preferably, the front surface 148 of the body member 102 is a substantially planar surface. However, in some embodiments, some variation in contour is contemplated. For example, the surface may be roughened to provide improved adhesion with the face component 104. Alternatively, or in addition, the front surface 148 may include one or more projections and/or recesses adapted to mate with corresponding projections and/or recesses of the face component 104.

The flange 150 preferably comprises a portion having a thickness less than 4 mm, more preferably between 2 mm and 3.5 mm, and even more preferably between 2.0 mm and 3.25 mm. Additionally, or alternatively, the flange 150 includes a portion having a thickness no greater than 0.1 in. More preferably, such thickness is located at a forwardmost location of the flange 150. Preferably, the face component 104 comprises a maximum thickness that is no less than 4.0 mm.

Dimensioning the flange 150 in this regard may provide for greater design flexibility of the face component 104 in view of regulations promulgated by one or more golf equipment regulatory bodies, e.g. the United States Golf Association (USGA). For example, as of the date of this application, the USGA requires that inserts located in the face of a club head be "flush with the rest of the face." The USGA also provides tolerances with which to determine conformance of this rule. However, by limiting the flange thickness (and thus limiting land area on the striking face about the face component 104), the face component 104 of the club head 100 may be less likely to be considered an insert for purposes of this analysis by the USGA. This may particularly be the case if the insert extends to within 0.1 in from the perimeter of a striking face when projected into a vertical plane that is parallel to a virtual vertical hosel plane that includes a hosel axis, when a club head is oriented in the reference position. Thus, in turn, such tolerances beneficially may not apply to the club head 100 as described above. For example, the flange 150 may extend further forward than the striking face 130 as defined by the face component 104, e.g. by at least 0.1 mm and more preferably by at least 0.2 mm. A flange so dimensioned may be advantageous in correcting the swing timing of a golfer, particularly one whom tends to top-cut a golf ball at impact. By increasing the forward extent of the flange 150 relative to the striking face 130, the golfer may be likely to perceive a striking face more forward than in the absence of such extending-forward of the flange 150. As a result, the golfer may inadvertently be more likely to apply at impact a more appropriate club head orientation that may include a more appropriate dynamic loft and/or a more appropriate launch angle.

Figure 13:
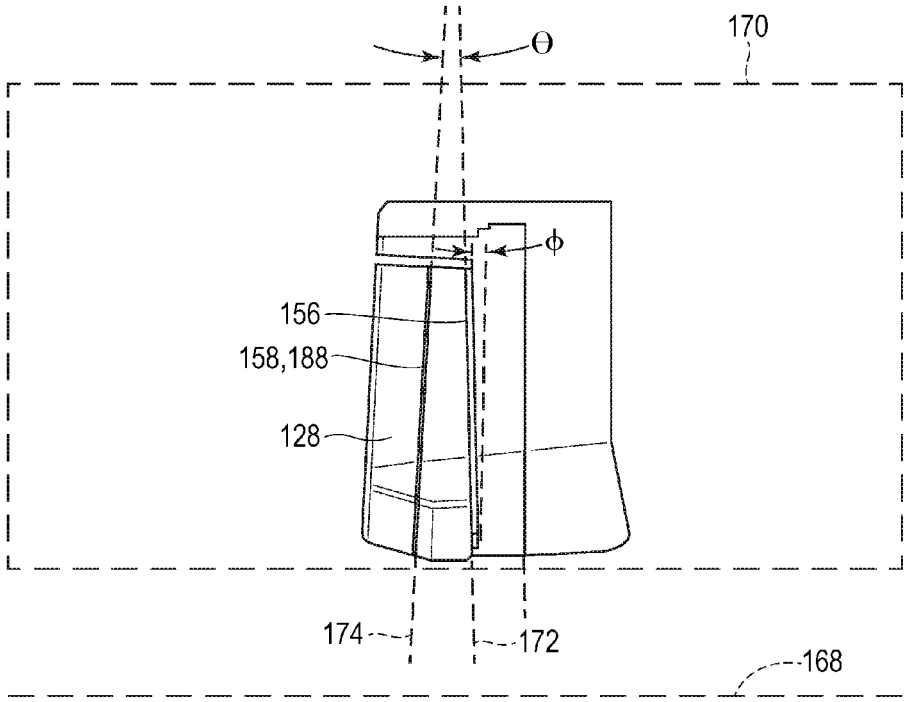
FIG. 13 is a heel side elevation view of a detail portion of the golf club head of FIG. 1.
Figure 14:
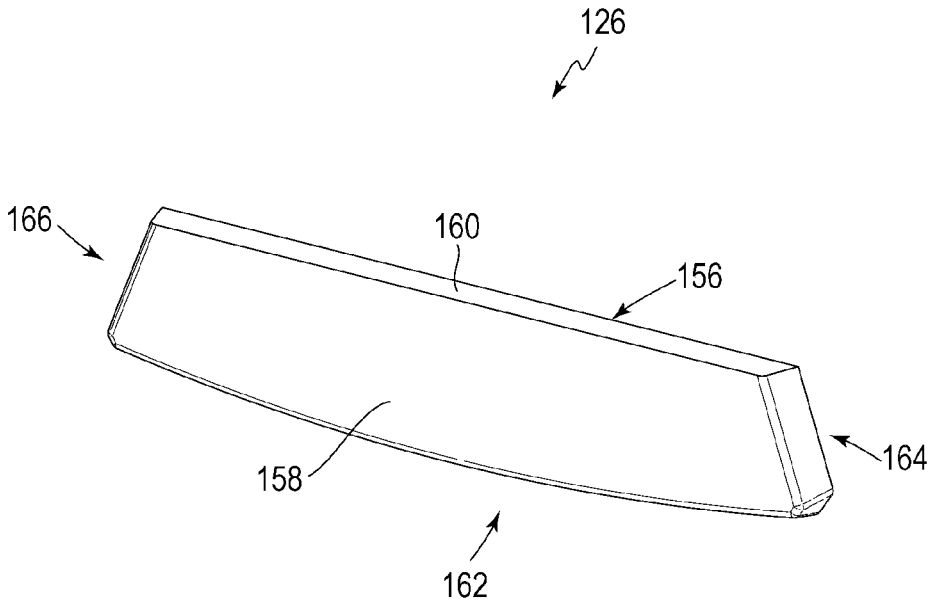
FIG. 14 is front perspective view of an insert component of the golf club head of FIG. 1.

The first insert 126, as described above, preferably constitutes a compressible element. Referring to FIGS. 13 and 14, the first insert 126 may comprise a rearward surface 156 and a forward surface 158 opposite the rearward surface 156. The first insert 126 further comprises a top surface 160, a bottom surface 162 opposite the top surface 160, a heel surface 164, and a toe surface 166 opposite the heel surface 164. The first insert 126 preferably comprises a resilient material, e.g. a polymeric material. Specifically, the first insert 126 is formed of a material having a hardness no greater than 60 Shore D, more preferably within the range of 30 Shore D to 50 Shore D, and even more preferably substantially equal to about 39 Shore D. In some embodiments, the first insert 126 comprises a thermoplastic urethane. Providing a compression element (i.e. the first insert 126) having such characteristics results in improved tactile rebounding characteristics upon impact. An insert having these properties may likely be a noticeably softer putter than what a golfer may typically be used to and may even be considered soft to the touch, further communicating the intended behavior of the putter face component 104.

The rearward surface 156 of the first insert 126 may contact the front surface 148 of the body member 102 (see e.g. FIG. 2). Preferably, the first insert 126 is coupled to the body member 102 e.g. by chemical adhesion of the rearward surface 156 with the front surface 148 of the body member 102. Further, preferably at least one of the heel surface 164 and the toe surface 166 is visually exposed and, more preferably, physically exposed. In other words, the front surface 148 of the body member 102 is preferably continuously planar entirely from a central portion outward toward at least one of the heel, toe, and bottom portion. More preferably, the front surface 148 is continuously planar from a central portion toward each of the heel, toe, and sole portions. Exposing the first insert 126 and/or the second insert 128 on at least one of the heel surface 164 and the toe surface 166 communicates to a golfer the tactile response behavior intended by the club head 100. Such exposure may also provide additional alignment features to ensure proper orientation during a putting stroke. For these reasons, the first insert 126 preferably exhibits a white, or whitish, color. This characteristic further provides a clear contrast from the color and/or texture of the second insert 128, which is preferably of a dark, black, and/or copper color. Preferably, the first insert 126 is formed in part of a UV-protectant chemical additive to prevent discoloration over time due to UV exposure. This contrast further draws attention to the first insert 126 and more particularly its front-to-rear shape, as will be described further below.

As shown in FIG. 13, the first insert 126 preferably comprises a trapezoidal profile in the front-to-rear direction. Particularly, the rearward surface 156 of the first insert 126 generally corresponds to a vertical planar surface (with the club head 100 in the soled position). The forward surface 158 of the first insert 126 is preferably angled relative to the vertical plane 172. The shaping of the compression layer in this manner is believed to apply static loft to the putter. Particularly, a plane 174 coincident with (or generally parallel with) the forward surface 158 of the first insert 126 forms an angle $\theta$ with the vertical plane 172. Preferably, the angle $\theta$ is no less than 1°, more preferably between 2° and 6°, and even more preferably substantially equal to about 4°.

Because of the forward-leaning angle ϕ of 1°, the forward surface when secured to the body member 102 in an operable state exhibits a static loft angle of preferably between 1-4°, and more preferably about 3°. Such construction improves the castability of surfaces of the body member 102, particular in a die cast environment. However, other angular combinations are contemplated, particularly if the body member is formed by other means, e.g. machined. For example, if the front surface 148 of the body member 102 is intended to be milled, a draft angle ϕ of 0° may be more suitable. Also, exposing the first insert 126, bearing its trapezoidal profile, indicates a high-thickness sole portion of a resilient material, thereby communicating high resiliency, which is believed to be a factor affecting performance.

Preferably, the variously shown and described contour features (including recesses, edges, etc.) are formed as cast-in features (as opposed to being machined), where die casting is employed in forming the body member 102. Forming contours and design features in this manner minimizes the visible presence of porous nature of the die cast formed piece, which may be considered to detract from the overall appearance of the body member 102. However, in some embodiments, some or all contour features described herein (or in addition thereto) are applied by machining.

By forming the first insert in this manner, e.g. of a resilient material with thickness gradually increasing toward the bottom surface 162, overall performance is believed to be improved. For example, consider a case in which the putter head 100 impacts a golf ball with sufficient force to substantially fully compress the first insert 126. A ball struck low on the face will likely leave the putter face at a lower launch angle than a ball struck high on the face due to operation of the aforementioned first insert geometry. This is advantageous for at least for the following reason: when contact is made high on the face, it may typically be caused by forward pressed hands, in which case the loft of the putter would be artificially decreased and the resulting launch angle may be less than optimal. When contact is conventionally made low on the face 130, it may be because the user's hands have "broken" or allowed the putter head to contact the ball when in-front of the hands and thereby be dynamically lofted. Added loft may lead to a launch angle that is higher than optimal. The above-described first insert 126 geometry may act to overcome such natural tendencies. In effect, such structural formations decrease a golfer's shot dispersion, particularly in terms of dispersion of roll distance.

The first insert 126 further comprises a flange 176 projecting from a bottom portion. Particularly the flange 176 extends rearward continuously and integrally with the bottom surface 162 of the first insert 126. The flange 176 may be secured to the bottom surface 114 of the body member 102 and may, thus, form a portion of the bottom, or sole, surface of the club head 100. The flange 176 may be advantageous in providing increased surface area for forming an adhesive bond in securing the first insert 126 to the front surface 148 of the body member 102. In some embodiments, an adhesive material is applied between the first insert 126 and the front surface 148 of the body member 102. In some such embodiments, the adhesive is of the form of a two-sided tape, optionally having visco-elastic properties. Preferably, an adhesive tape layer is applied to a top surface 178 of the flange 176 has a surface area no less than 200 $mm^2$, more preferably no less than 300 $mm^2$, even more preferably no less than 325 $mm^2$ and most preferably equal to about 350 $mm^2$. Such an adhesive tape preferably has a thickness no less than 0.2 mm and preferably no greater than 1.0 mm, more preferably between 0.2 mm and 0.6 mm, and even more preferably equal to about 0.4 mm.

Because of the optional forward-leaning angle ϕ of 1°, the angle formed between the rearward surface 156 of the first insert 126 and the top surface 178 of the flange 176 (as projected into a vertical plane perpendicular to the striking face 130) may equal 89°. However, in some embodiments, the bottom surface 114 of the body member includes a sole draft of about 1°. Thus, in such cases, such angle formed between the top surface 178 of the flange 176 and the rearward surface 156 of the first insert 126 is equal to about 90°. In any case, the surfaces of the first insert 126 intended to be chemically bonded to the body member 102 are preferably well-mated, thus minimizing the risk of poor adhesion.

Figure 6:
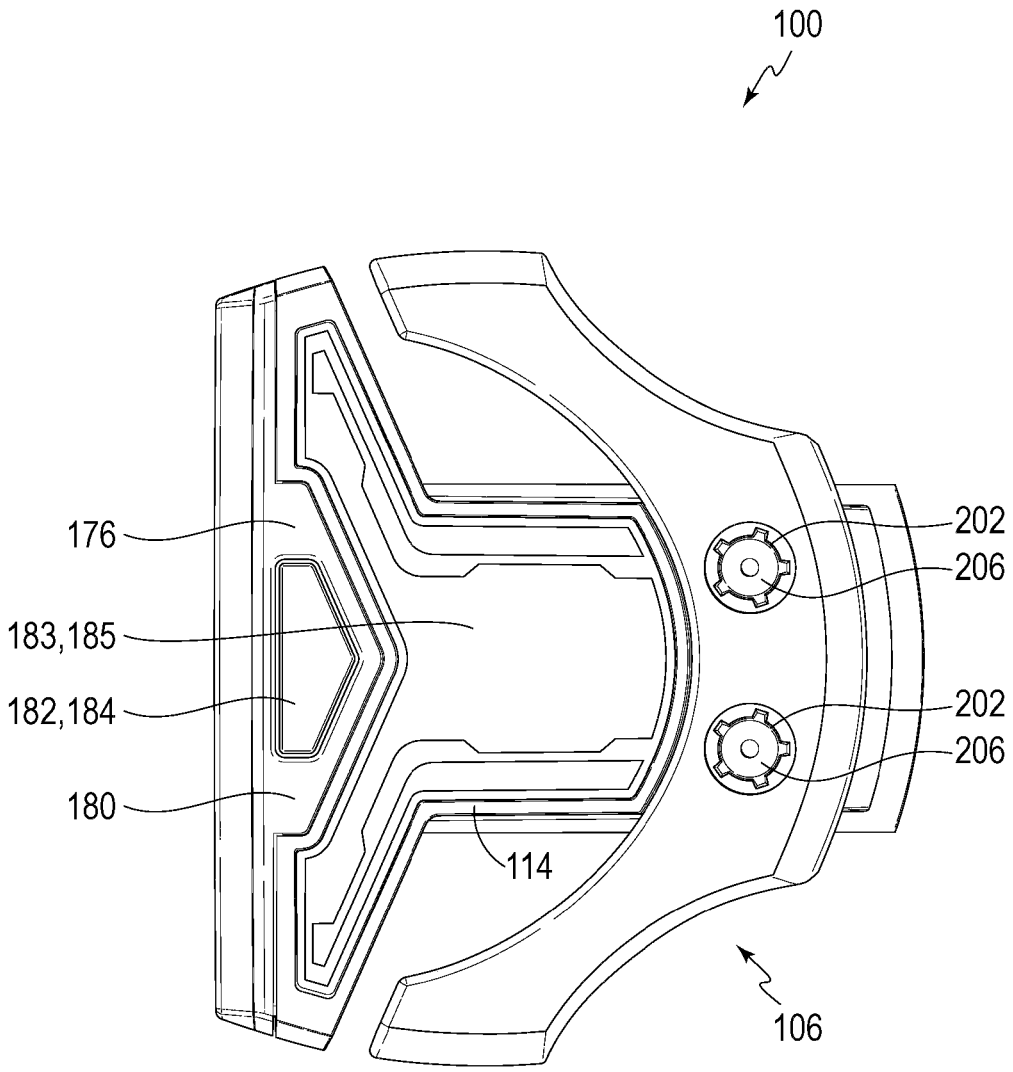
FIG. 6 is a bottom plan view of the golf club head of FIG. 1.
Figure 7:
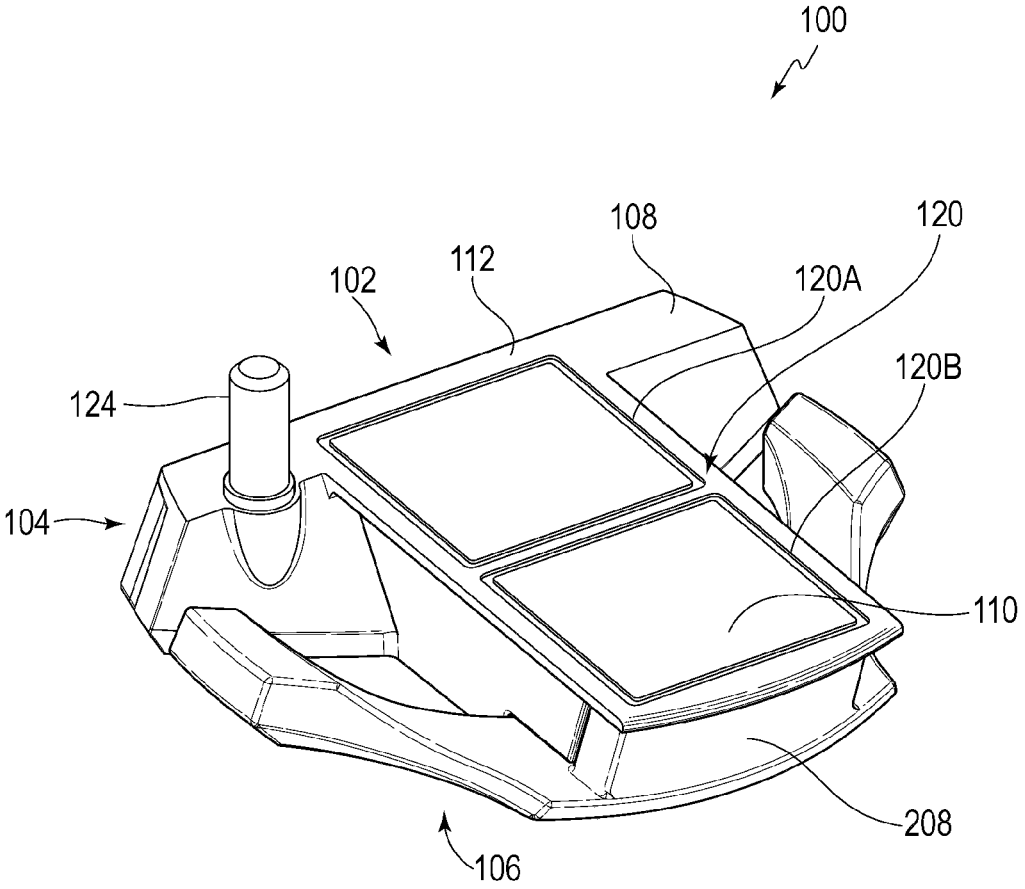
FIG. 7 is a rear perspective view of the golf club head of FIG. 1.
Figure 8:
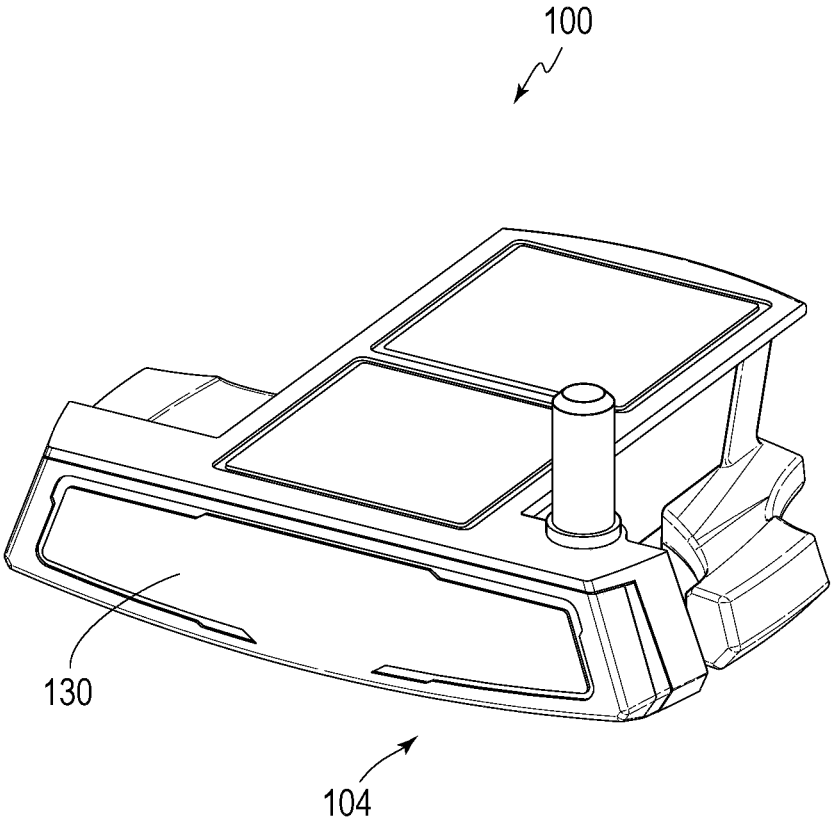
FIG. 8 is a front perspective view of the golf club head of FIG. 1.
Figure 15:
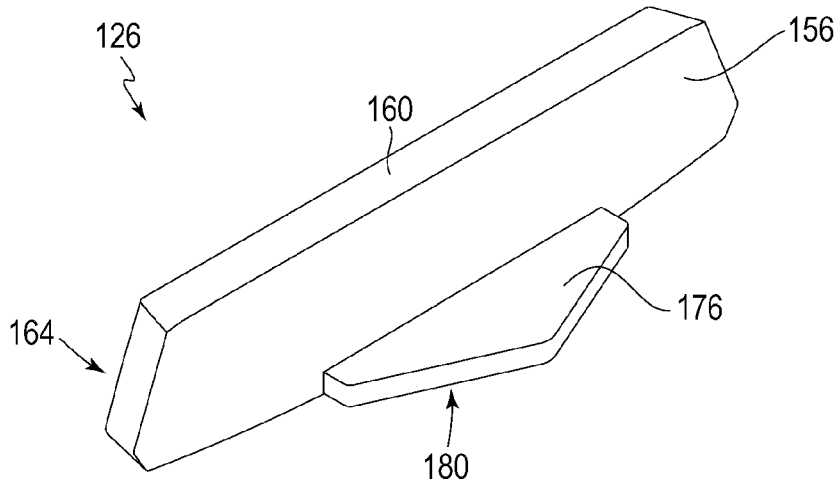
FIG. 15 is a rear perspective view of the insert component of FIG. 14.
Figure 16:
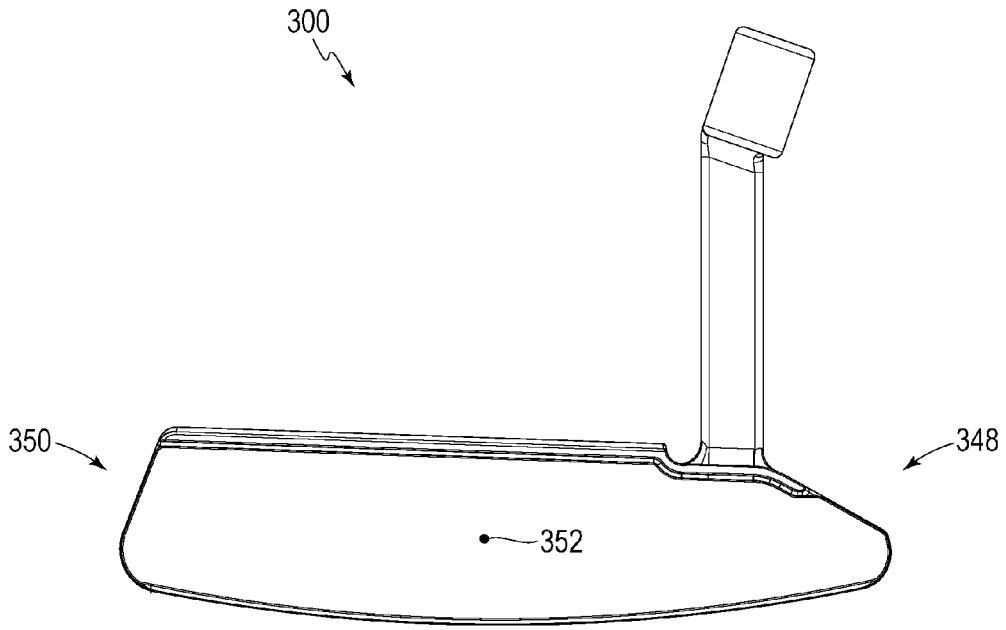
FIG. 16 is a front elevation view of a golf club head in accordance with one or more embodiments.
Figure 17:
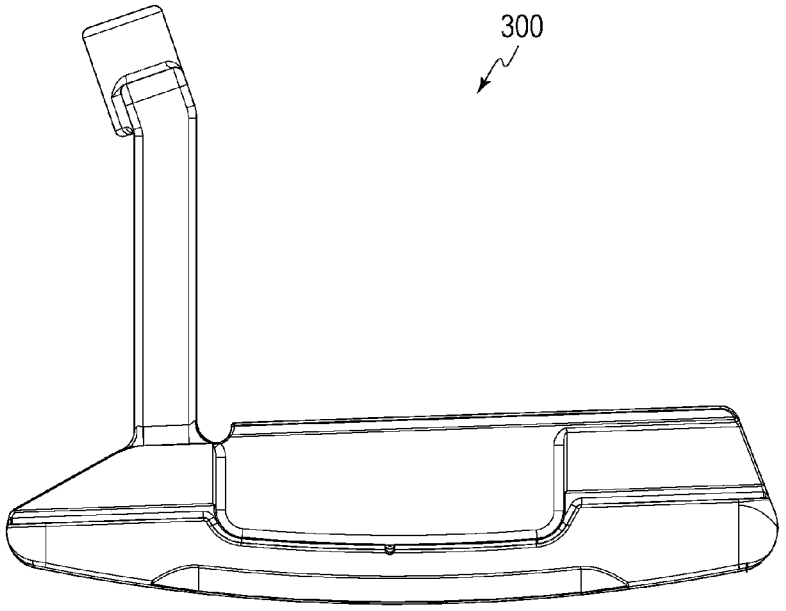
FIG. 17 is a rear elevation view of the golf club head of FIG. 16.
Figure 18:
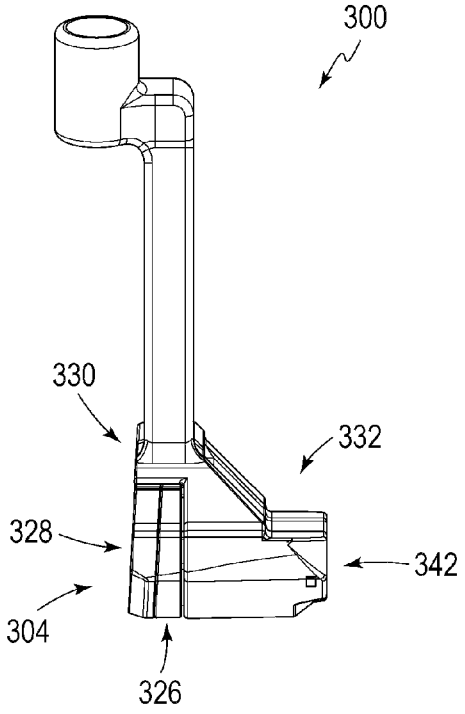
FIG. 18 is a heel-side elevation view of the golf club head of FIG. 16.

Referring to FIGS. 6 and 15, in some embodiment, the flange 176 further comprises a bottom surface 180 that may include a recess 182. The recess 182 may be at least partially filled, e.g. with an insert 184 being a plaque or medallion. Indicia may be positioned on the external surface of the plaque 184. Preferably the recess 182 has a depth of no less than 0.75 mm, more preferably no greater than 2.0 mm, even more preferably between 1.00 mm and 1.50 mm, and yet more preferably equal to about 1.33 mm. An adhesive two-sided tape may also be sandwiched between the plaque 184 and bottom surface 180 of the flange 176 to secure the plaque 184 to the flange 176. The tape preferably bears structural dimensions as discussed above with regard to adhesion of the first insert 126 with the body member 102.

In some embodiments, the body member 102 comprises a recess 183 located on the bottom surface 114 or sole portion. The recess 183 is preferably at least partially filled, e.g., with an insert 185 being a plaque or medallion. Indicia may be positioned on the external surface of the plaque 185. Preferably the recess 183 has a depth of no less than 0.75 mm, more preferably no greater than 2.0 mm, even more preferably between 1.00 mm and 1.50 mm, and yet more preferably equal to about 1.33 mm. Alternatively, or in addition, the depth of the recess 183 is similar to the depth of the recess 182. An adhesive two-sided tape may also be sandwiched between the plaque 185 and bottom surface 114 of the body member 102 to secure the plaque 185 to the body member 102. The tape preferably bears structural dimensions as discussed above with regard to adhesion of the first insert 126 with the body member 102. In some embodiments, as shown in FIG. 6, the plaque 185 (and optionally the recess 183) defines a periphery that generally follows a periphery of the body member 102 when viewed in bottom plan and as projected into the virtual ground plane when the golf club head 100 is oriented in a reference position. Additionally, or alternatively, as projected in the same ground plane, in the reference position, the plaque 185 preferably occupies a planar area that is no less than 25% of the total planar area defined by the bottom surface 114 of the body member 102. More preferably, the plaque occupies a planar area that is no less than 50% of the total planar area defined by the bottom surface 114 of the body member 102. Even more preferably, the plaque occupies a planar area being the majority of the total planar area defined by the bottom surface 114 of the body member 102. Most preferably, the plaque occupies a planar area that is no less than 75% of the total planar area defined by the bottom surface 114 of the body member 102. As discussed above, die cast aluminum may comprises a relatively high porosity. This high porosity may, in some cases, detract from the appearance of the club head, particularly of a surface of such die case piece is polished, machined, or abraded. Thus, masking portions of the surface of the body member, in these such embodiments, by the placement of inserts formed of other materials better suited for abrasion, may advantageously reduce visibility of such porous characteristic and/or reduce exposure of high porosity materials to abrasion during use. In some embodiments, other surface of the club head are significantly masked with lower-porosity materials. However, at least the bottom portion includes such masking discussed above due to its greater overall exposure to abrasion during use. Alternatively, or in addition, provided that the plaque 185 is located on the bottom portion 114, the plaque 185 may be susceptible to abrasion during use as well as static grounding during user alignment. Accordingly, the plaque 185 is preferably dimensioned to fit substantially within the recess 183 and, more preferably, entirely within the recess 183. In some such embodiments, the plaque 185 (or substantial exterior surface portions thereof) is flush with the bottom surface 114.

The second insert 128 may comprise a cap element and at least partially cover the forward surface 158 of the first insert 126. Preferably the second insert 128 is of a material that is less resilient that the first insert 126 and/or preferably harder than the material of the first insert 126. In some embodiments, the second insert 128 comprises aluminum or an aluminum alloy. Aluminum, as opposed to denser conventional metals, enables the relocation of more significant mass from the front portion of the club head to more desirable locations e.g. the rear and outer portions for increasing the moment of inertia of the club head 100, and thus providing for a more forgiving club head.

Preferably the second insert is forged and comprises a thickness of between 2 mm and 6 mm, more preferably between 3 mm and 5 mm, and even more preferably equal to about 3.6 mm. However, other forms of manufacture are contemplated, for example machining, milling, and stamping. Because of this desired thickness, however, forging may be a more desirable form of manufacture than stamping. In some embodiments, additional surface processing and/or machining operations are applied. For example, a fly cutter may be applied the surface of the second insert to ensure thicknesses are within intended tolerances. Exemplary fly cutter operational parameters include a feed rate of between 20 and 25 mm/s, and a cutter rotational speed of between 7,000 and 9,000 rpm, more preferably equal to about 8,000 rpm.

Figure 11:
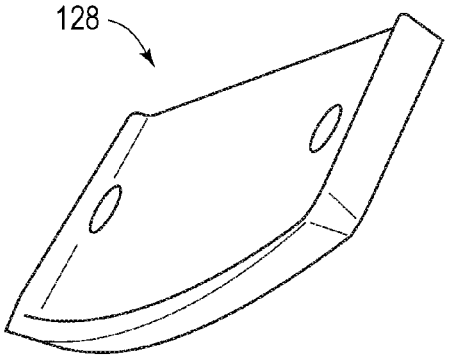
FIG. 11 is a perspective view of an insert component of the golf club head of FIG. 1.
Figure 12:
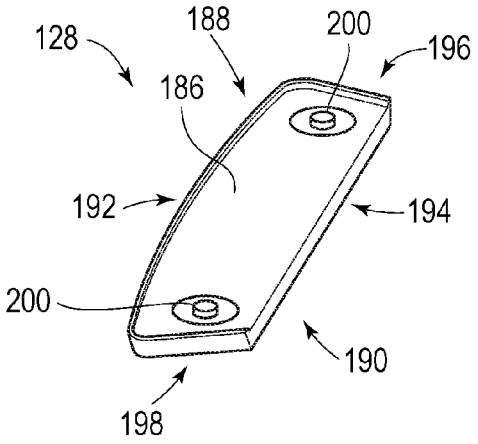
FIG. 12 is a perspective view of the insert component of FIG. 11.

Referring to FIGS. 2, 11 and 12, the second insert 128 may further include a rear surface 188, a front surface 190 opposite the rear surface 188, a top surface 192, a bottom surface 194, a heel surface 196, and a toe surface 198. The front surface 190 may form a portion of the striking face 130 of the club head 100 and, more preferably, the majority of the striking face 130. In some embodiments, the striking face 130 consists entirely of the front surface 190 of the second insert 128 and the front surface of the flange 150 of the body member 102.

The rear surface 188 preferably includes a recess 186. Preferably, a peripheral wall is formed around the entire periphery of the recess 186. However, in some embodiments, the recess 186 may be at least partially open, outwardly from a central location. In some embodiments, an adhesive material is located within the recess 186 and adapted to secure the second insert 128 to the first insert 126. In some such embodiments, the adhesive material comprises a two-sided adhesive tape bearing structural characteristics as described above with regard to the two-sided tape optionally located between the first insert 126 and the front surface 148 of the body member 102.

In some optional embodiments, one or more locater projections 200 and/or recesses are associated with the rear surface 188 of the second insert 128 that correspond to and are adapted to mate with corresponding recesses and/or projections of the forward surface 158 of the first insert 126. However, such features are not required and may in fact deleteriously result in the presence of air pockets between the respective surfaces of the two inserts. In some embodiments, the second insert 128 is formed by a casting process. In some such embodiments, at least the rear surface 188 of the second insert 128 is machined, e.g., for purposes of increasing dimensional precision to ensure adequate adhesion between the second insert 128 and the first insert 126.

Based on a preferred depth of the face component 104 relative to a forwardmost extent of the body member 102, a positive-type hosel is preferable. Such a configuration renders moot the requirement of a large bore extending from the top surface 112 of the body member 102. The blade portion 108 may need to be thickened (i.e. increased in width) to accommodate the large bore. Such thickening may negatively affect the distribution of mass of the club head. At a minimum, such thickening may require the use of structural mass, thereby reducing mass available specifically for purposes of performance enhancement (i.e. "discretionary mass"). Also, the presence of a large bore in close proximity to the face component 104 may cause deficit in structural integrity (e.g. by resulting in too thin of a wall between the face component 104 and the hosel bore). However, in some embodiments, an internal bore extends from the top surface 112 for receiving a shaft or shaft adapter.

In some embodiments, a positive-type hosel is integrally formed with the body member 102, e.g. a cast-in element. However, as discussed above, the putter head 100 is preferably formed by die casting. Accordingly, a cast-in positive-type hosel may likely require a chamfered surface, e.g. of about 1.5°. Such structures however have been identified as potentially resulting in poor consistency in assembly. Also, casting-in an element requiring an added height of, e.g., 20 mm may lead to increased manufacturing costs, particularly in a die cast environment.

Additionally, as discussed above, forming club head elements of separate components permits customizing materials to the particular functions of the structure of which they constitute. For example, in some cases, it may be desirable for a putter head, such as putter head 100, to include a hosel having bendable properties such that adjustment may be applied to the shaft position (e.g. a change in lie angle or a change in loft angle). Yet, as described in above embodiments, it may be desirable to form a putter head by die casting. Materials suitable for die casting purposes may differ from materials capable of providing bendability (e.g. in a hosel component of a club head). Accordingly, the inventors have recognized that greater acceptance may be realized by forming a club head main body of a material suitable for die casting, and structurally suited for a main body, while a different material may be incorporated into a hosel portion, e.g. in the manner of a separate aft-attached hosel component 124. Preferably, the body member 102 is formed of aluminum alloy. However, other materials are also possible. In this case, aluminum may not be a material of sufficient strength to withstand the degree of moment applied by a bending bar in providing such an adjustment. Thus, in such embodiments (i.e. when the body member is formed of aluminum or an aluminum-alloy), the separately-attached hosel component 124 is preferably formed of a milled steel. Of course, other materials are possible, particularly those of relatively high strength.

In some embodiments, the aft-attached hosel component 124 is coupled to a double-bend type shaft. In such cases, preferably the golf club formed of the double-bend shaft and the golf club head 100 is configured to conform with regulations promulgated by the United States Golf Association (USGA) and/or other regulatory bodies that govern equipment used in golf. For example, such shaft is preferably formed such that it is substantially straight from a grip end to a point no more than 5 inches from a virtual ground plane when the golf club is oriented in the reference position. Accordingly, the double-bend portion of the shaft is preferably located entirely within a space defined as between the virtual ground plane and a height of 5 inches therefrom, provided also that the shaft bears complementary geometry to the positive hosel component 124 at its tip end to securably accommodate the positive hosel component 124.

The top surface 112 of the body member 102 thus includes a recess 122 preferably forming a bore of generally circular cross-section. At least in part for the reasons described above, the recess 122 preferably has a diameter less than the diameter of a tip of a conventional shaft. More preferably the diameter of the recess 122 is no greater than 8 mm and more preferably equal to about 6 mm.

Figure 9:
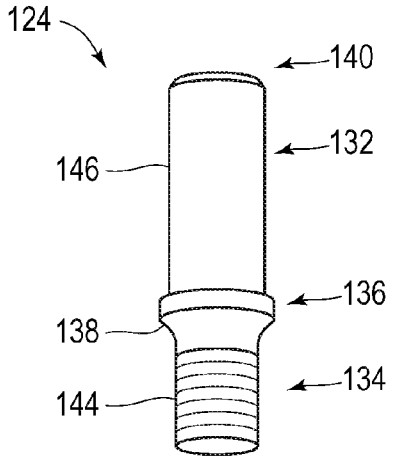
FIG. 9 is a perspective view of a hosel component of the golf club head of FIG. 1.
Figure 10:
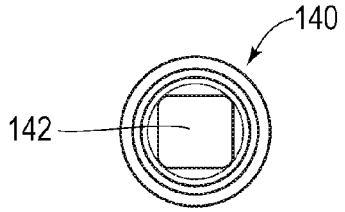
FIG. 10 is a bottom plan view of the hosel component of FIG. 9.

In some embodiments, referring to FIGS. 9 and 10, the hosel component 124 includes a top portion 132 and bottom portion 134. An annular ridge 136 may be located intermediate the top portion 132 and the bottom portion 134. The annular ridge may provide a bearing surface for the top surface 112 of the body member 102 in joining the hosel component 124 with the body member 102. A fillet 138 may be located between the annular ridge 136 and the bottom portion 134. Such fillet may reduce stresses common during the performance of the club head, as well as during a hosel adjustment process using a conventional bending bar. Bearing such applications in mind, the fillet is preferably of a radius no less than 1 mm, more preferably no less than 1.5 mm, and even more preferably substantially equal to about 1.9 mm.

Referring again to FIGS. 9 and 10, the bottom portion 134 may include a threaded portion 144. Similarly, the recess 122 preferably includes a corresponding threaded surface (not shown) for rotatable engagement with the threaded surface 144 of the bottom portion 134 of the hosel component 124. The top portion 132 may further comprise a generally cylindrical side surface 146 and a top surface 140. The top surface 140 preferably includes a tool socket 142 for operatively receiving a portion of a fastening tool. Such a tool may comprise a conventional screw driver, wrench, allen wrench, allen key, torx wrench, a wrench having a polygonal cross-section (e.g. square), a wrench having a proprietary cross-sectional shape, or the like. In one or more aspects of the present invention, the fastening tool includes a torque-sensing device and, optionally, an indicator for indicating, to the user, the current torque being applied to the fastener and/or when a threshold torque has been reached or exceeded. By enabling the use of a torque wrench, assemblers may ensure that appropriate torque is consistently applied.

In addition (or alternatively) to mechanically attaching the hosel component 124 to the body member 102, an epoxy or other chemical adhesive may be applied between the hosel component 124 and the body member 102. Alternatively, the hosel component 124 may be attached to the body member 102 by other mechanical means, such as press-fit or bolting, or alternatively, welding, brazing, or other attachment means suitable for such application. Preferably, an epoxy is used to couple a shaft (not shown) to the side surface 146 of the top portion 132 of the hosel component 124. The annular ridge 136 may also provide a bearing surface upon which a tip end of the shaft may be affixed to provide axial securement and ensure consistent location of the shaft from club head to club head during the assembly process.

In some embodiments, a flange on the trapezoidal shape side of the compression layer, which also continues across the bottom surface of the compression layer, may also partially fill the gap between the face cap (second insert 128) trailing edge and main body (body element 102) leading edge. The flange may fill the gap sufficiently to effect a purposefully "clean" and well-fitting look, but not so much as to cause fit interference as the thickness of the face cap, compression layer and main body face pocket vary according to manufacturing tolerances.

In some embodiments, the bottom portion 106 constitutes a separate body component. In some embodiments, the bottom portion 106 is adapted to be removable. For example, the bottom portion 106 may be secured to the body element 102 with mechanical fasteners such as one or more screws. The screws may include a threaded shaft portion and a head portion having a top surface 204. The top surface 204 may include a tool socket 206 for operatively receiving a portion of a fastening tool. Such a tool may comprise a conventional screw driver, wrench, allen wrench, allen key, torx wrench, a wrench having a polygonal cross-section (e.g. square), a wrench having a proprietary cross-sectional shape, or the like. In one or more aspects of the present invention, the fastening tool includes a torque-sensing device and, optionally, an indicator for indicating, to the user, the current torque being applied to the fastener and/or when a threshold torque has been reached or exceeded. By enabling the use of a torque wrench, assemblers may ensure that appropriate torque is consistently applied. In some embodiments, an adhesive, such as epoxy, is applied to the threaded shaft to result in permanent or semi-permanent securement. One or more resilient elements such as O-rings or gaskets may located within recesses in the body element 102 and between the body element 102 and the fasteners 202. Such resilient members may ensure a snug fit and prevent loosening during use due in part to vibrations emanating throughout the various components of the club head 100.

Alternatively, or in addition, a tape layer of a resilient material may be adhered between the body element 102 and the bottom portion 106. The resilient material may be formed of a polymer, such as rubber, polyamide, polyurethane, polyester, or similar material. In some such embodiments, the resilient material comprises a visco-elastic material preferably having damping properties selected to reduce propagation of undesirable-frequency vibratory waves that may be result from impacts of the club head during typical use. This benefit is particularly suited to embodiments having heel arm 210 and/or toe arm 212 that constitute significant amounts of mass in cantilevered formation. Given their length and mass, the heel arm 210 and toe arm 212 (i.e. elements serving as cantilevered mass features) may be particularly susceptible to propagation of undesirable low frequency vibrations. Such counteracting vibration absorption systems are further preferable in embodiments in which such heel arm and toe arm include mass features located outward of either central, less massive, portions of such heel and toe arms.

In some embodiments, such visco-elastic tape is further coupled with a rigid mass body, i.e. a metallic plate comprising steel, titanium, zinc, aluminum, or alloys thereof. Accordingly, such system of visco-elastic material and rigid constrained layer may provide for a more effective damping system. In some such embodiments, such damping system is not located between the bottom portion 106 and the body member 102, but is optionally spaced from the intersection of such components. In some embodiments a visco-elastic material-comprised damping system, such as any of those described above, is secured to the top surface, bottom surface, rear surface and/or side surface of the bottom portion 106.

The bottom portion 106 is preferably formed of a material having a density greater than the density of the main body 102. Particularly, the main body 102 is preferably formed of a material having a density within the range of 1 g/cm$^3$ to 6 g/cm$^3$, more preferably between 2 g/cm$^3$ and 4 g/cm$^3$. The bottom portion 106 preferably has a density greater than 4 g/cm$^3$, and more preferably within the range of 6 g/cm$^3$ and 10 g/cm$^3$. Preferably the bottom portion 106 comprises zinc or a zinc alloy. The bottom portion includes a central mass element 208, a heel arm 210 projecting from a heel side of the central mass element 208, and a toe arm 212 projecting from a toe side of the central mass element 208.

Figure 3:
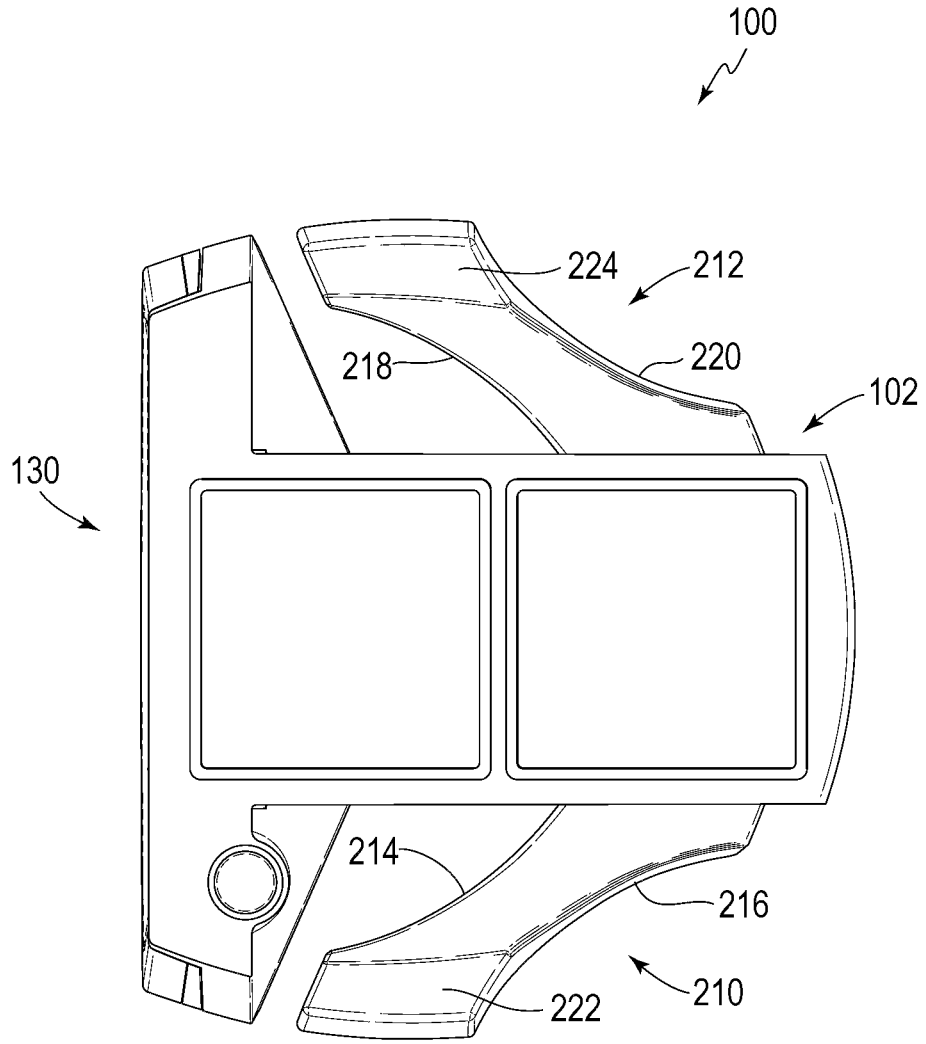
FIG. 3 is a top plan view of the golf club head of FIG. 1.
Figure 4:
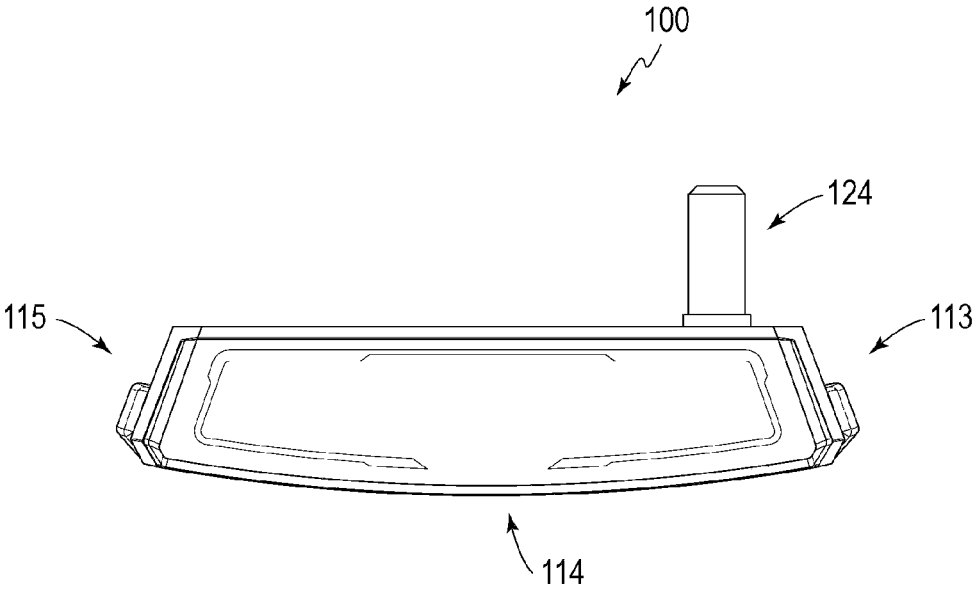
FIG. 4 is a front elevation view of the golf club head of FIG. 1.
Figure 5:
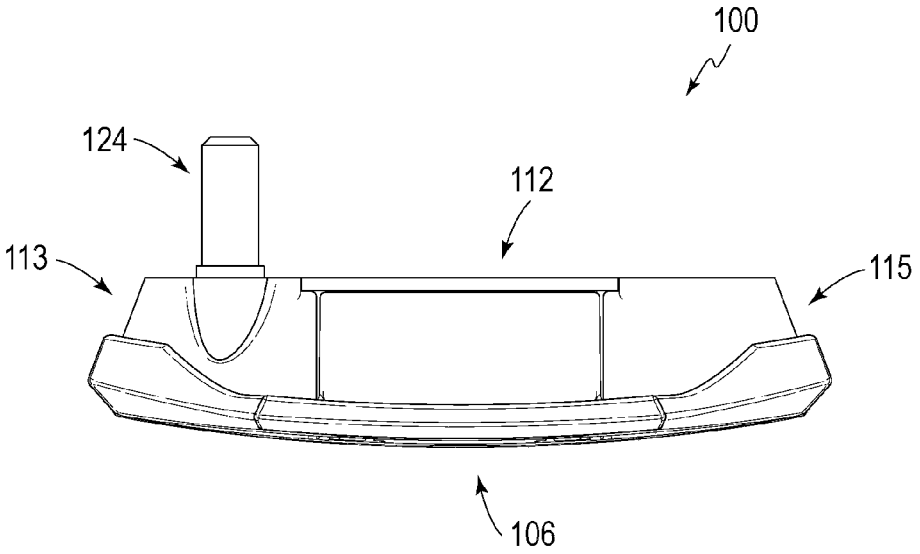
FIG. 5 is a rear elevation view of the golf club head of FIG. 1.

The heel arm 210 preferably extends outwardly and forwardly of the central mass element 208, as may be shown in top plan view (see e.g. FIG. 3). Similarly, the toe arm 212 preferably extends outwardly and forwardly of the central mass element 208, and optionally in symmetrical manner with respect to the heel arm 210 about a vertical plane passing through a geometric center of the striking face 130 of the club head 100 and perpendicular to the general plane of the striking face 130 of the club head when the club head 100 is oriented in a soled position. Both the heel arm 210 and toe arm 212 preferably each include an elongate portion optionally having one or more concave side portions 214, 216, 218, and 220 (as may be viewed in top plan view). Each of the heel arm 210 and the toe arm 212 further preferably terminate forwardly in a forward mass element (e.g. mass elements 222 and 224). The bottom portion 106 may be formed by die casting.

In one or more embodiments, referring to FIGS. 16-23(*b*), a putter-type club head 300 includes a body element 302 and a face component 304. The face component 304 may include a first element 326 and a second element 328 having characteristics similar to those described with respect to the embodiment shown in FIG. 1 and as described above.

The body element 302 includes a blade portion 330 and a rear portion 332 that, in combination, form a sole (bottom) surface 334, a top surface 336 including a top line 338, a rear top surface portion 340, a rearward surface 342, and a front surface 344. A hosel 346 may project upward from the top line portion 338. In some embodiments, the hosel 346 extends from a heel portion 348. However, extension from a toe portion, a central portion, or a rearward portion are also options. Further, the hosel 346 may be substituted for an internal bore extending inward from the top surface 336 of the putter head 300.

Figure 19:
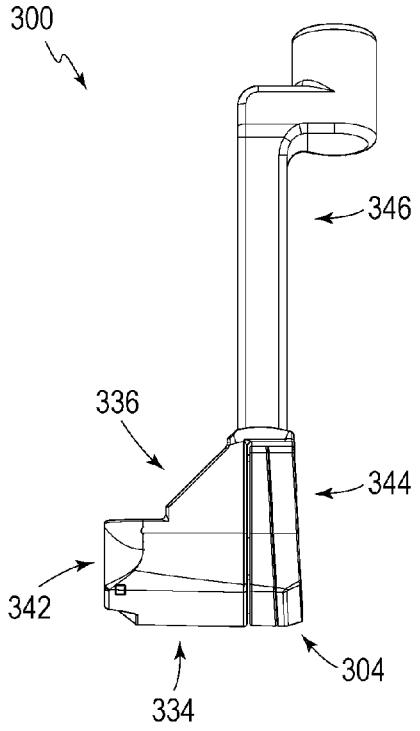
FIG. 19 is a toe-side elevation view of the golf club head of FIG. 16.
Figure 20:
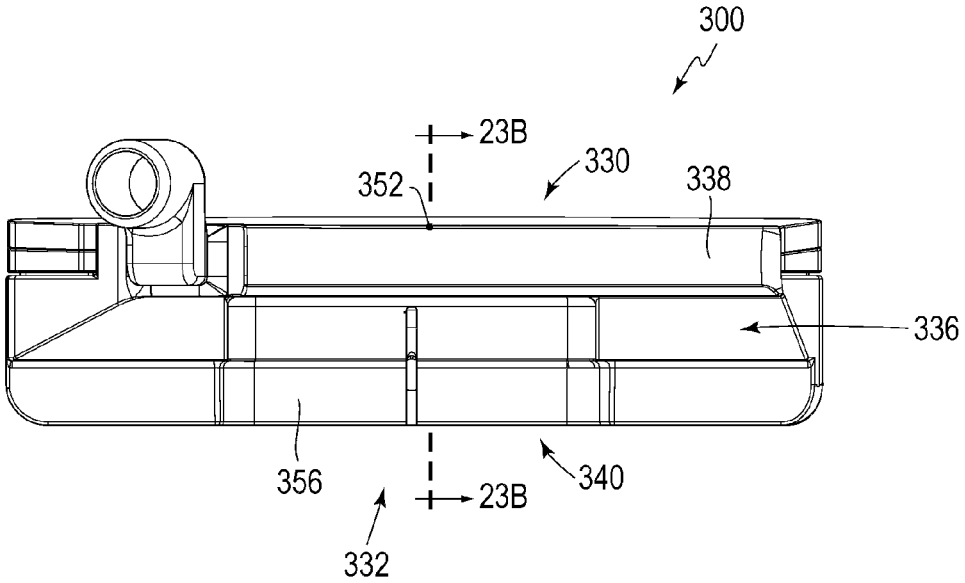
FIG. 20 is a top plan view of the golf club head of FIG. 16.
Figure 21:
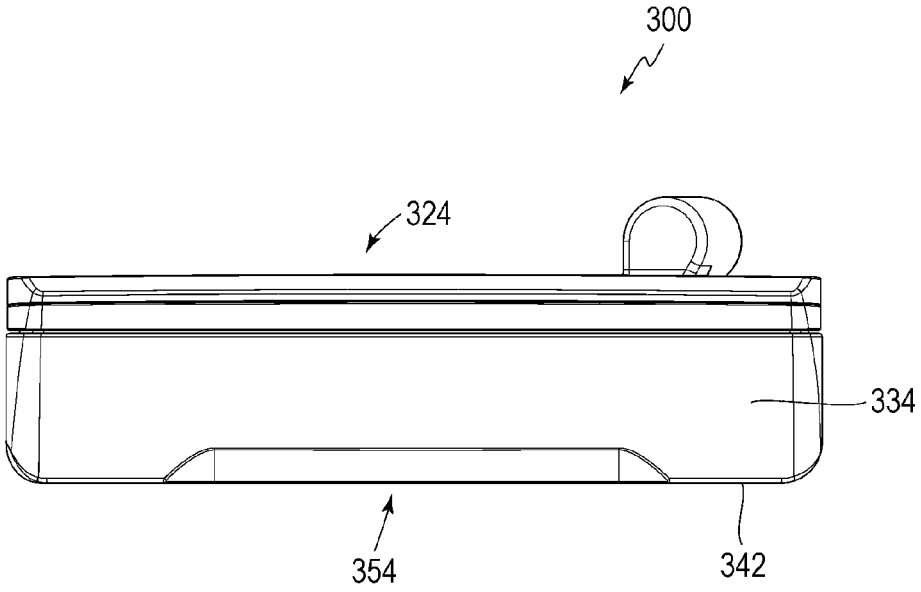
FIG. 21 is a bottom plan view of the golf club head of FIG. 16.
Figure 22:
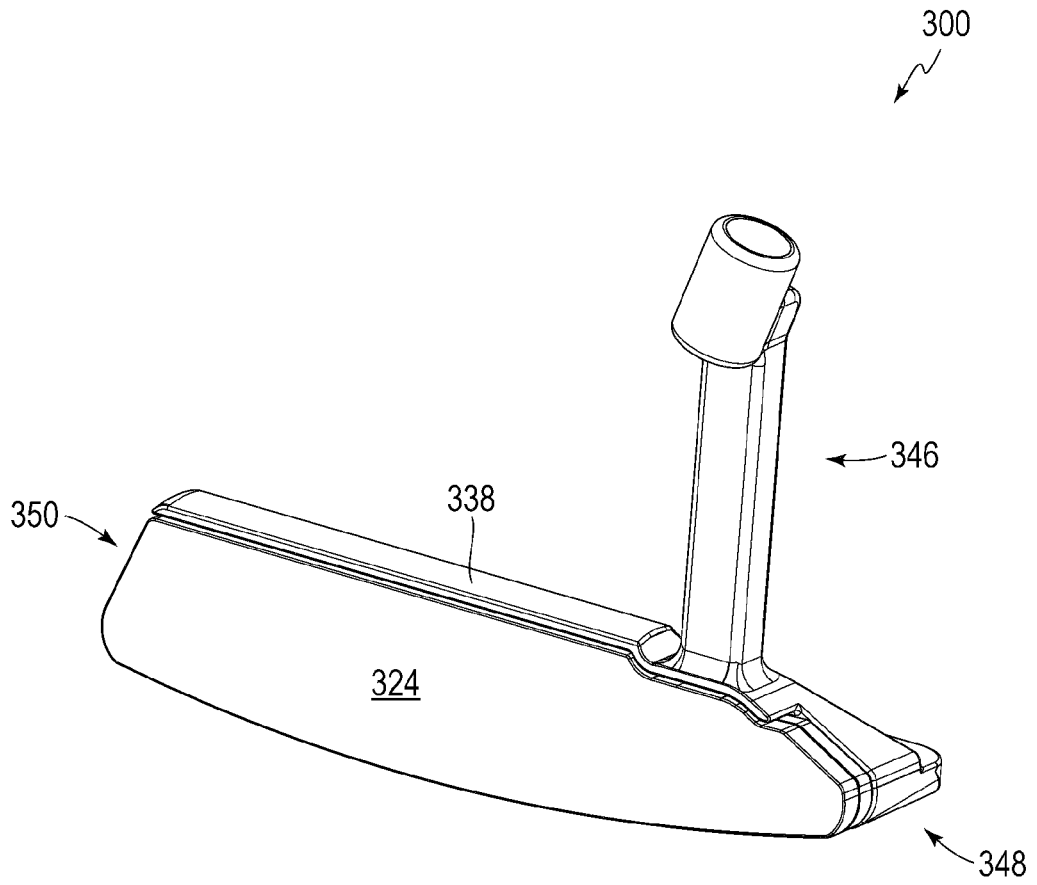
FIG. 22 is a front perspective view of the golf club head of FIG. 16.

In the particular embodiment shown in FIGS. 19 and 20, a face component 304 similar to the face component 104 of the embodiment of FIG. 1 is incorporated into a blade-shaped putter head 300. Such incorporation may be beneficial in providing the advantages associated with such a face component in a blade type putter, yet having advantages and desirable characteristics particularly suited for some golfers. However, as described above, the incorporation of such a face component 304 may result in necessary removal of a significant quantity of mass. In the case of a mallet-style putter, as in the embodiment of FIG. 1, such mass may appropriately, if not advantageously, be relocated to other regions of the putter head 100 without detraction. However, in the case of a blade-type putter head 300, the inventors believe relocation of the mass in a lesser-dimensioned space may detract from features typically sought after in a blade-type putter, e.g. accentuated heel and toe weights and a thin rear portion.

Figure 23A:
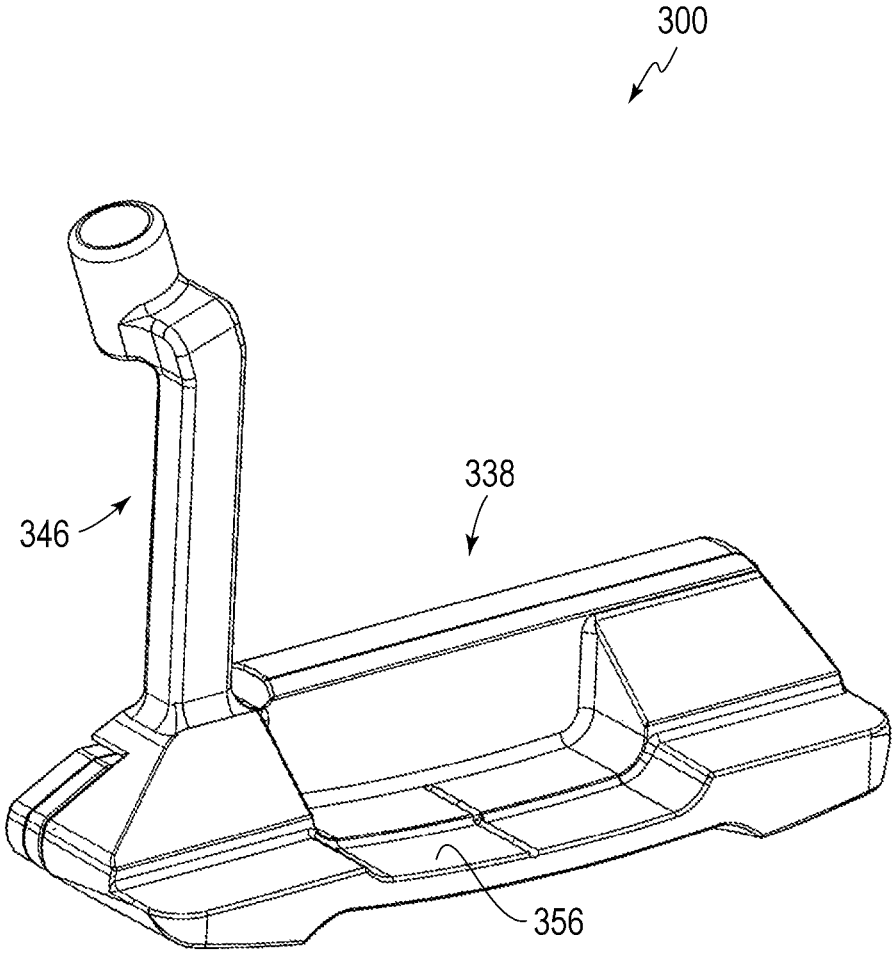
FIG. 23(*a*) is a rear perspective view of the golf club head of FIG. 16.
Figure 23B:
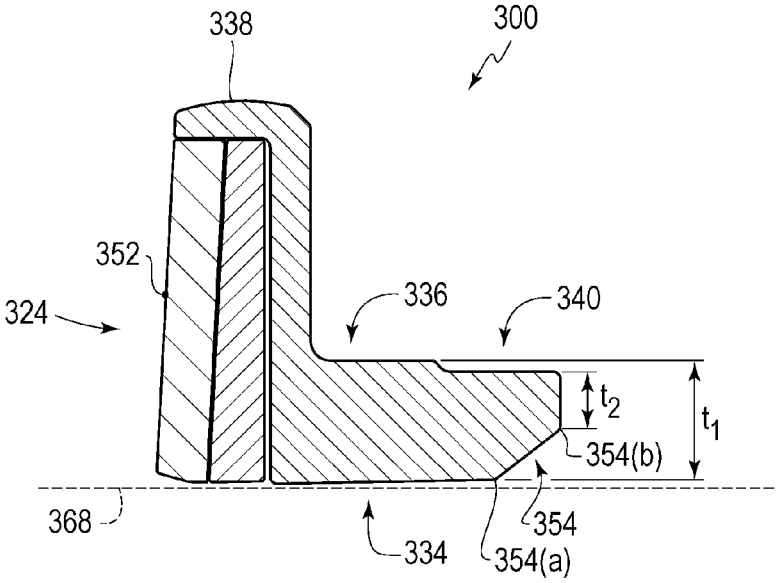

Accordingly, the rear portion 332 of the putter head 300 preferably includes at least one beveled surface 354. Preferably a bevel 354 is located on the bottom (sole) surface 334 proximate, and adjacent, the rearward surface 342. However, in some such embodiments, a second beveled surface is located on the top surface 336, in addition, proximate the rearward surface 342. Alternatively, and as shown in FIGS. 23(*a*) and 23(*b*), the top surface 336 of the rear portion 332 includes a central channel 356 extending in the front-to-rear direction. In either case, the rear portion 332 preferable tapers (e.g. by way of the bevel 354) from a first thickness (measured vertically at a forward endpoint 354(*a*) of the bevel 354), t1, no less than 5 mm to a second thickness (measured vertically at a second endpoint 354(*b*) of the bevel 354), t2, that is less than the first thickness. More preferably, the first thickness, t1, is between 5 mm and 10 mm, even more preferably between 5 mm and 8 mm. Also, preferably, the second thickness, t2, is no greater than 6 mm, more preferably no greater than 5 mm, and even more preferably within the range of 3 mm to 5 mm. These parameters are preferably satisfied at least in a central vertical cross-section passing through the geometric center 352 of the striking face 324 and perpendicular to the general plane of the striking face 324 (i.e. in the cross-sectional plane corresponding to the plane of the paper of FIG. 23(*b*)).

Additionally, or alternatively, the absolute difference between t1 and t2 is no less than about 2 mm, more preferably no less than about 2.5 mm, even more preferably no less than about 3.0 mm, and most preferably no less than about 3.5 mm. Alternatively, or in addition, a percent reduction in thickness between t1 and t2 (i.e. (t1−t2)/t1) is preferably no less than about 25%, more preferably no less than 30% and even more preferably no less than about 33%. These parameters are preferably satisfied at least in a central vertical cross-section passing through the geometric center 352 of the striking face 324 and perpendicular to the general plane of the striking face 324 (i.e. in the cross-sectional plane corresponding to the plane of the paper of FIG. 23(*b*)).

By structuring the rear portion 332 in this manner, the putter head 300 may satisfy desired mass distribution thresholds (provided a face component as described above), while maintaining attributes associated with and sought in connection with a blade-type putter.

Figure 24:
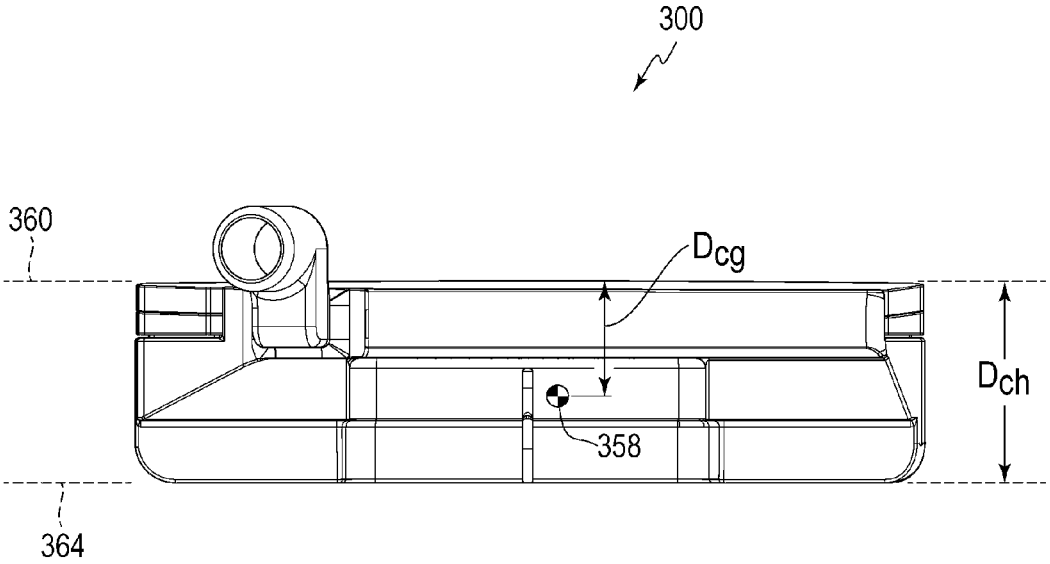
FIG. 24 is a top plan view of the golf club head of FIG. 16.
Figure 25A:
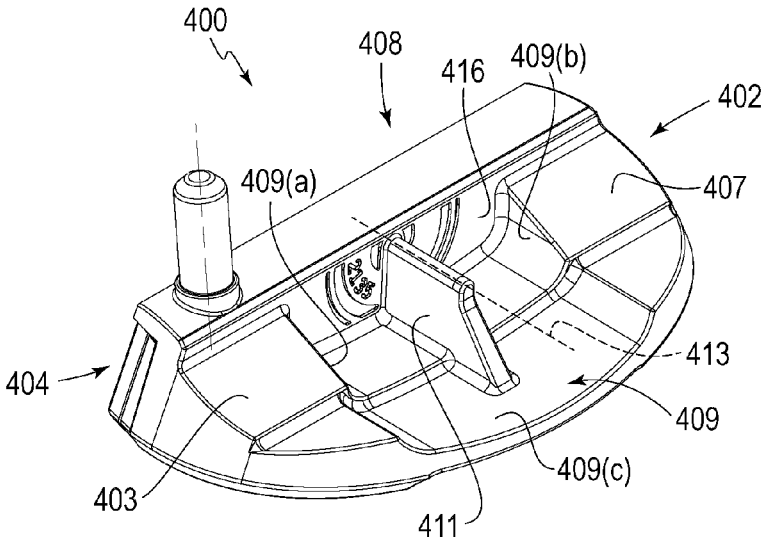
FIG. 25(*a*) is a rear perspective view of a golf club head according to one or more embodiments.
Figure 25B:
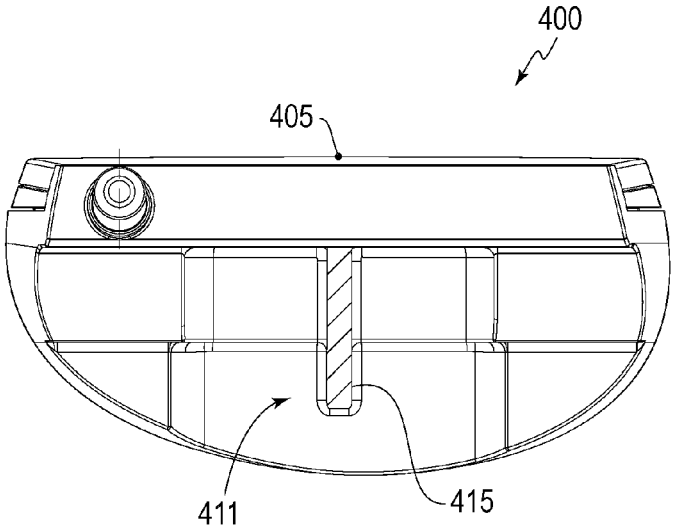
Figure 25C:
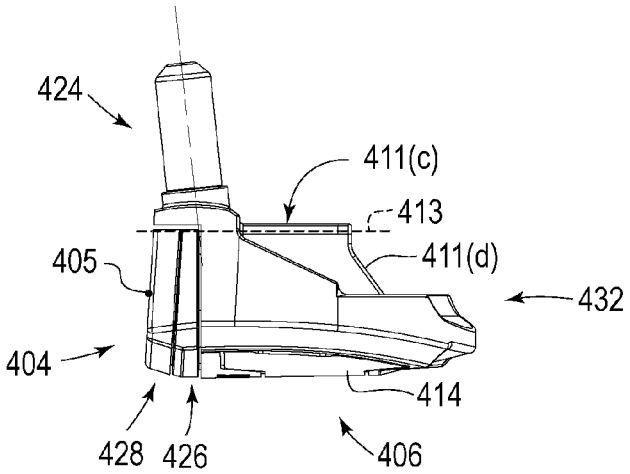
Figure 25D:
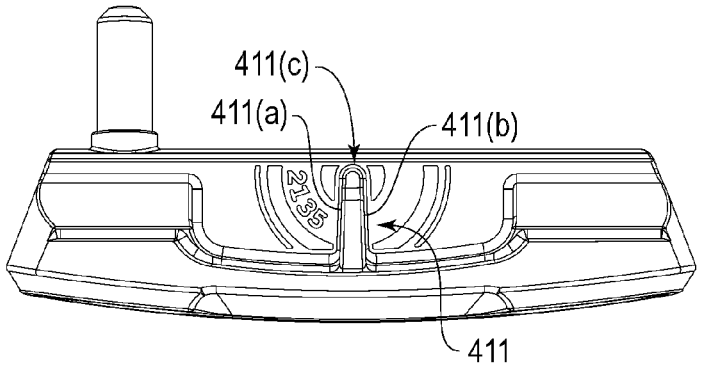
Figure 25E:
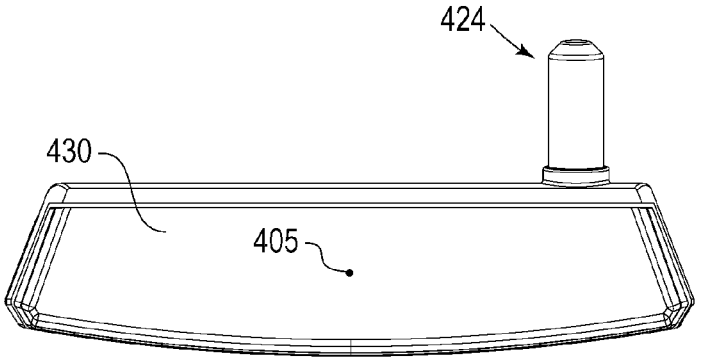
Figure 26A:
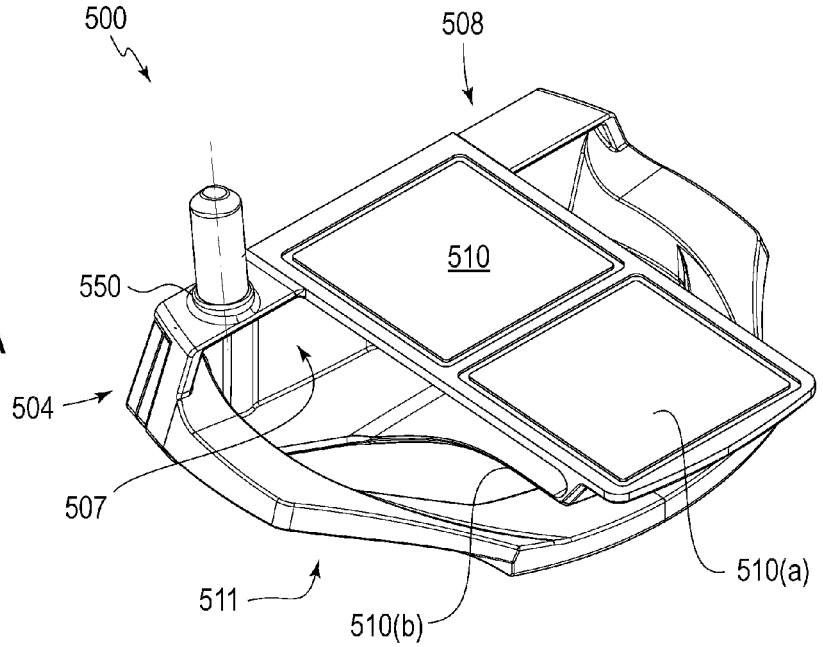
FIG. 26(*a*) is a rear perspective view of a golf club head according to one or more embodiments.
Figure 26B:
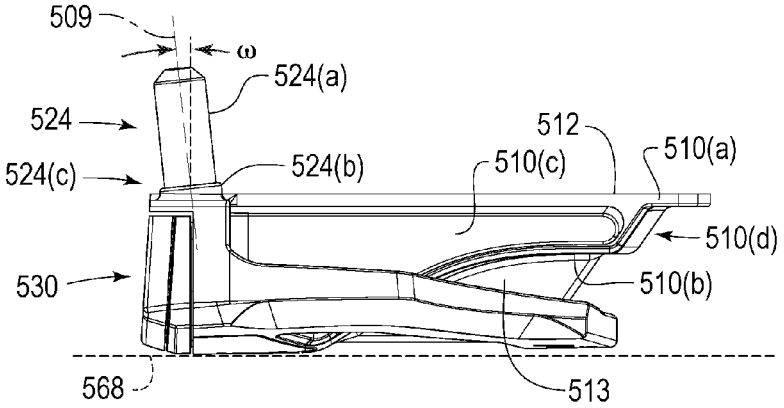
Figure 26C:
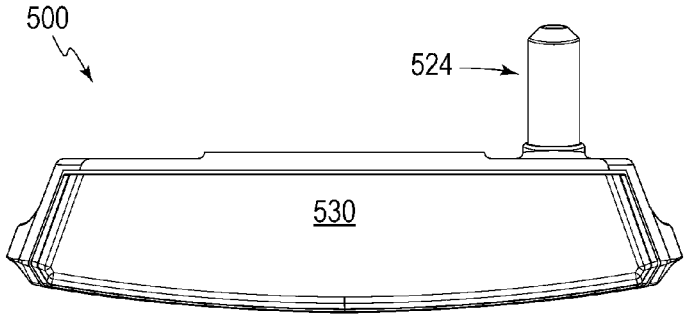
Figure 26D:
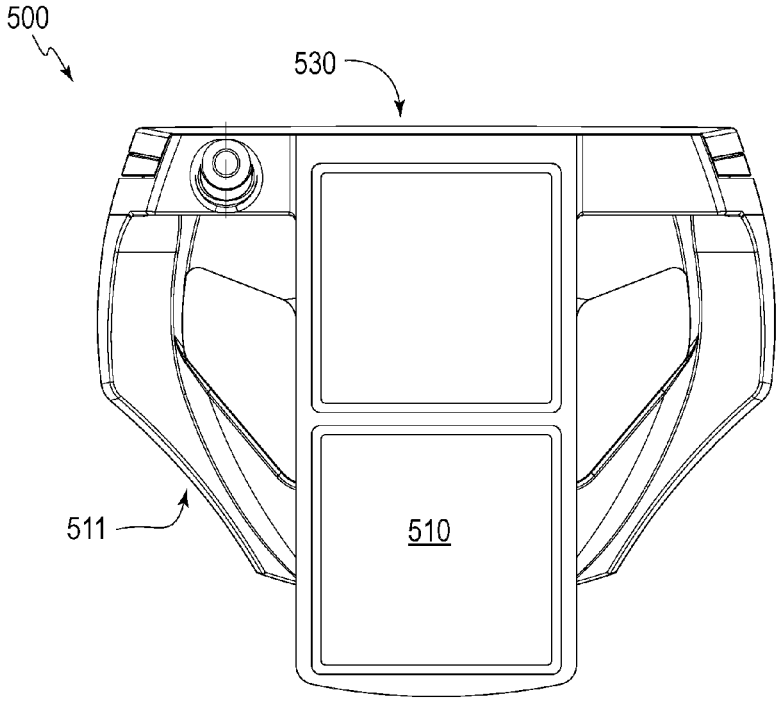
Figure 26E:
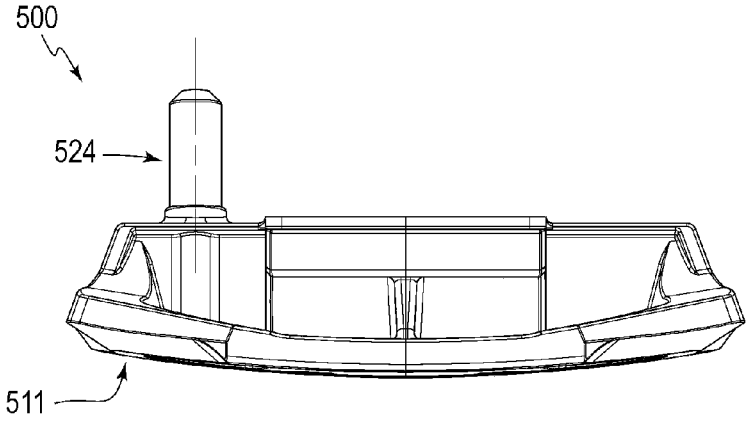
Figure 26F:
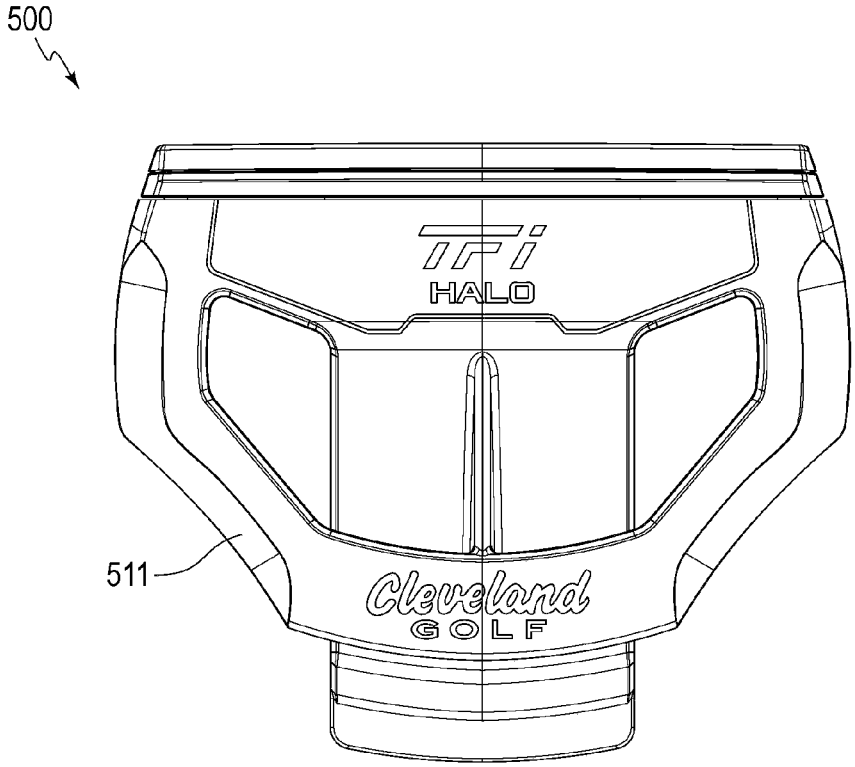
Figure 27A:
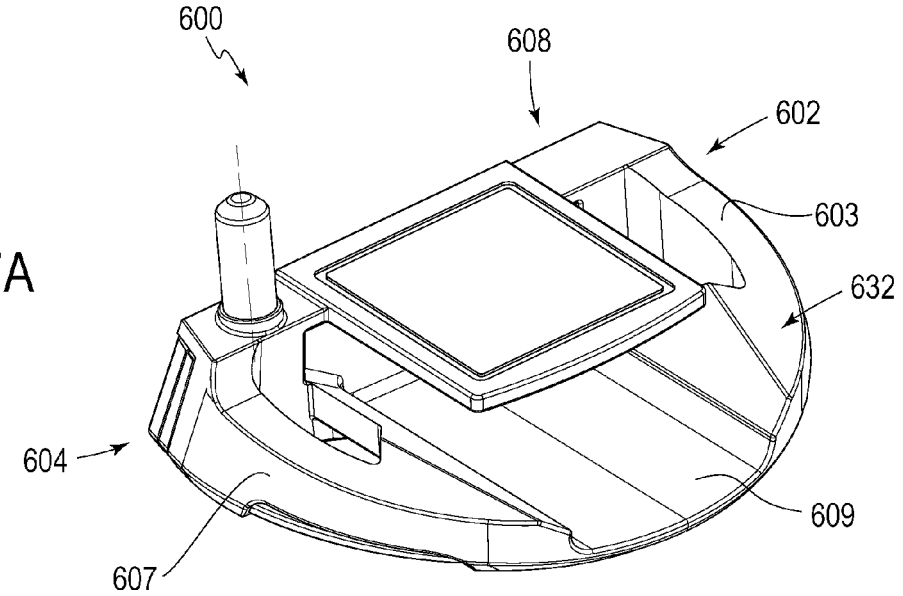
FIG. 27(*a*) is a rear perspective view of a golf club head according to one or more embodiments.
Figure 27B:
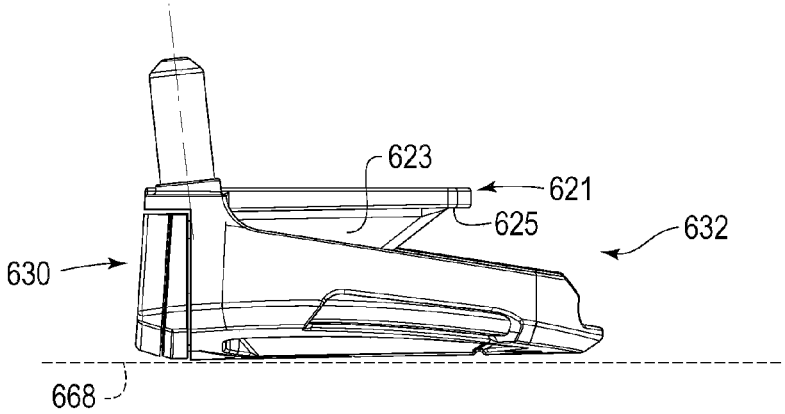
Figure 27C:
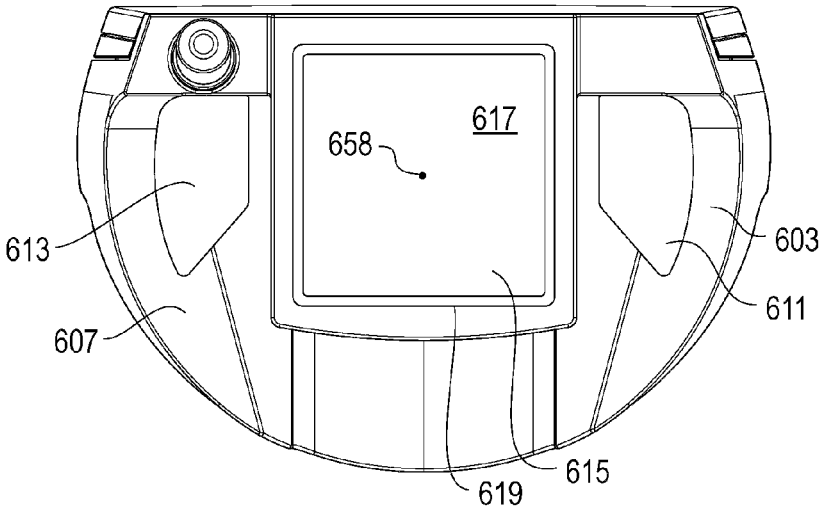
Figure 27D:
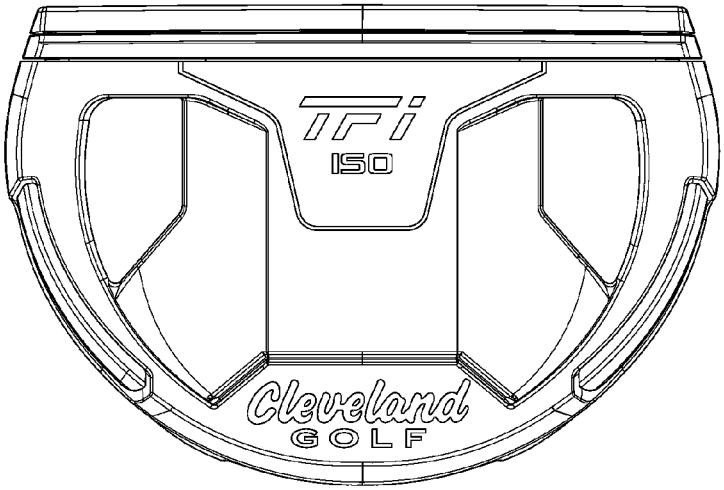
Figure 27E:
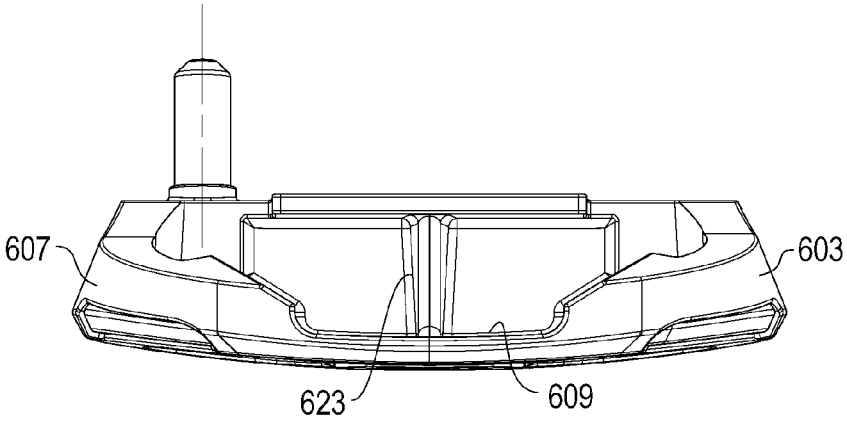
Figure 27F:
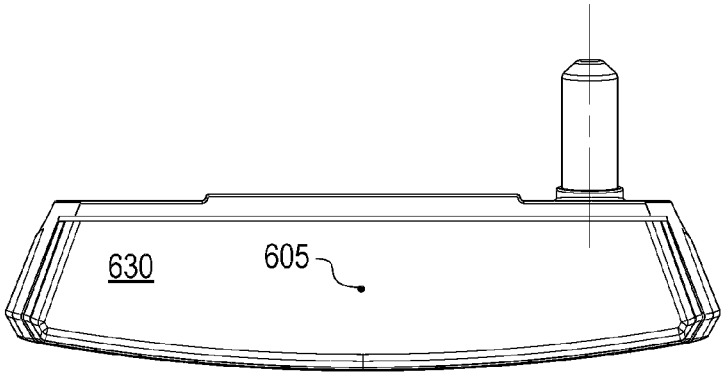
Figure 28A:
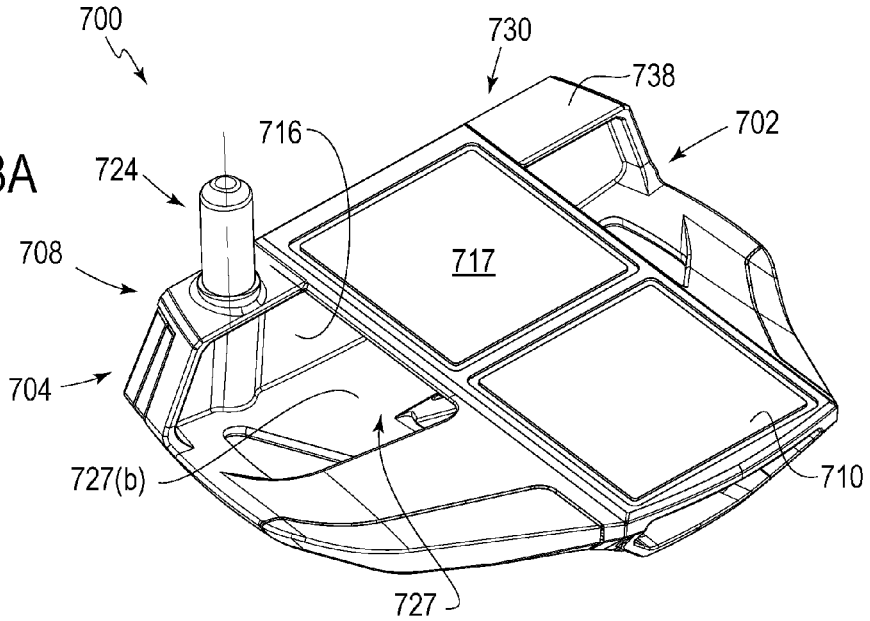
FIG. 28(*a*) is a rear perspective view of a golf club head according to one or more embodiments.
Figure 28B:
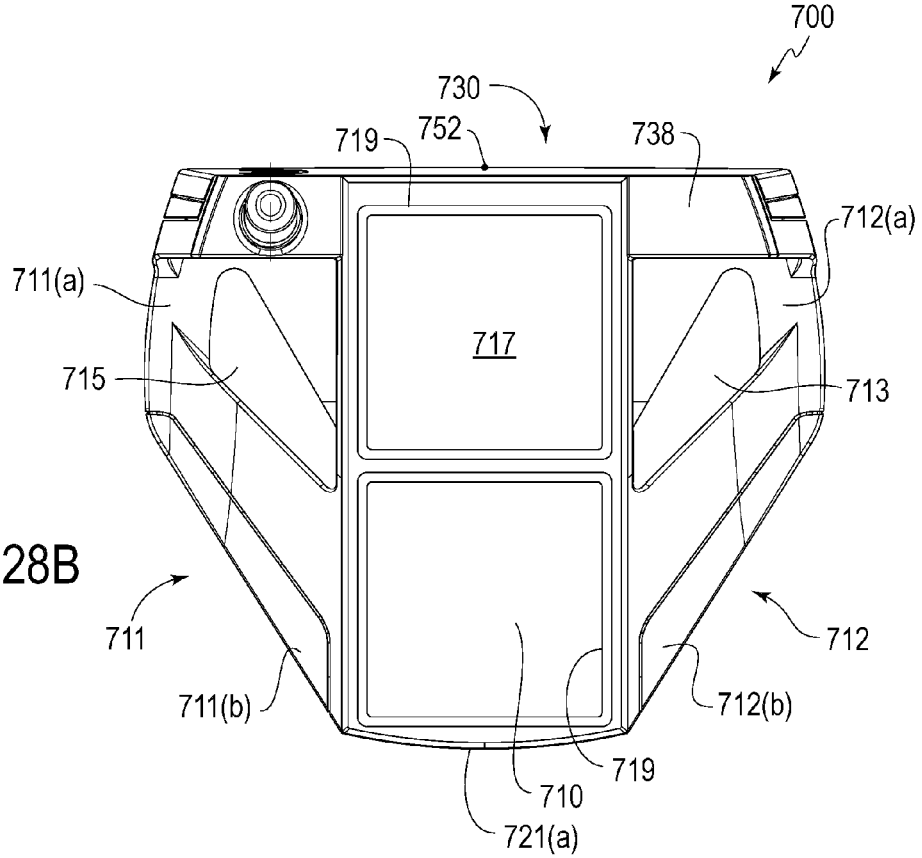
Figure 28C:
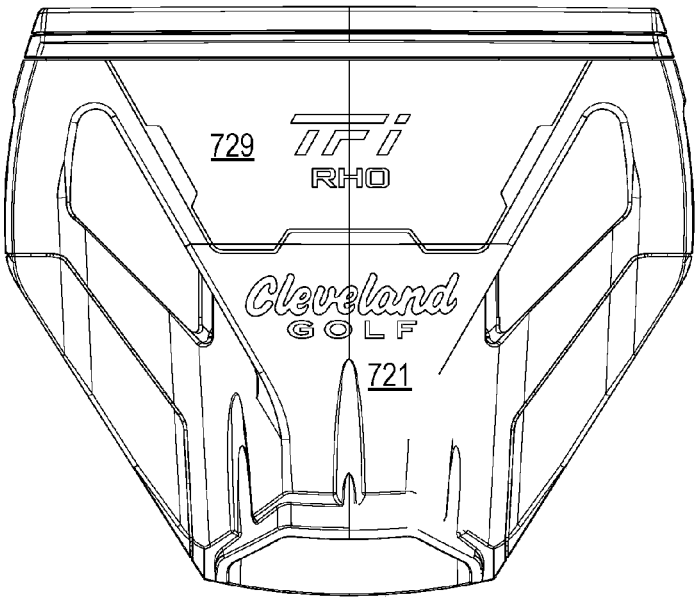
Figure 28D:
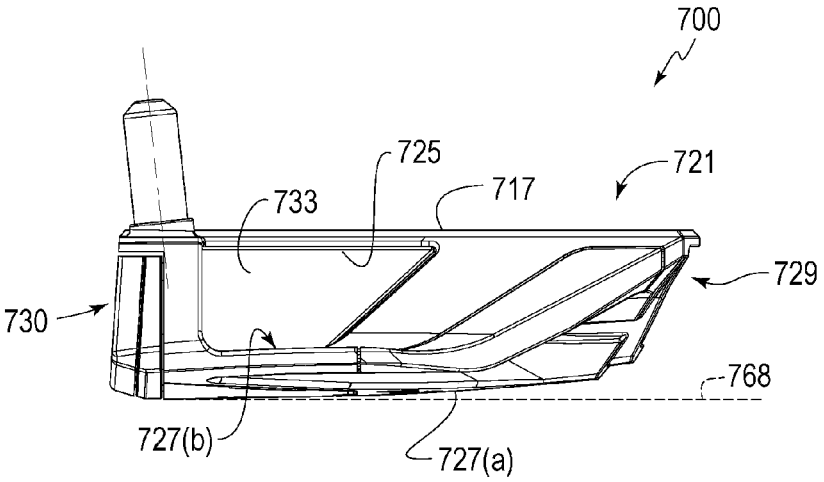
Figure 28E:
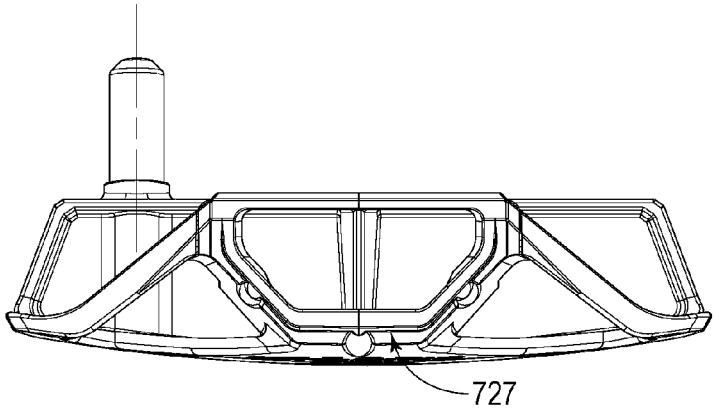
Figure 28F:
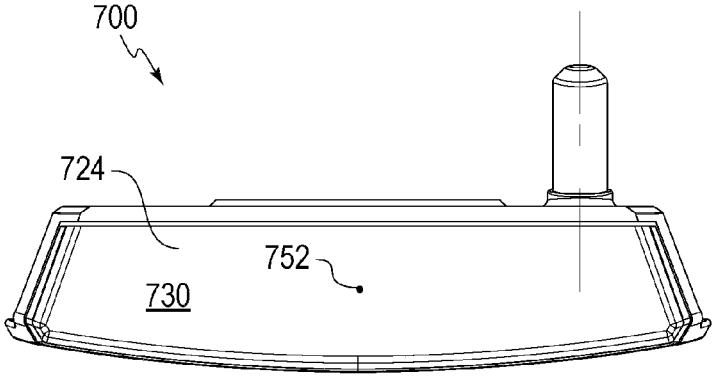
Figure 28G:
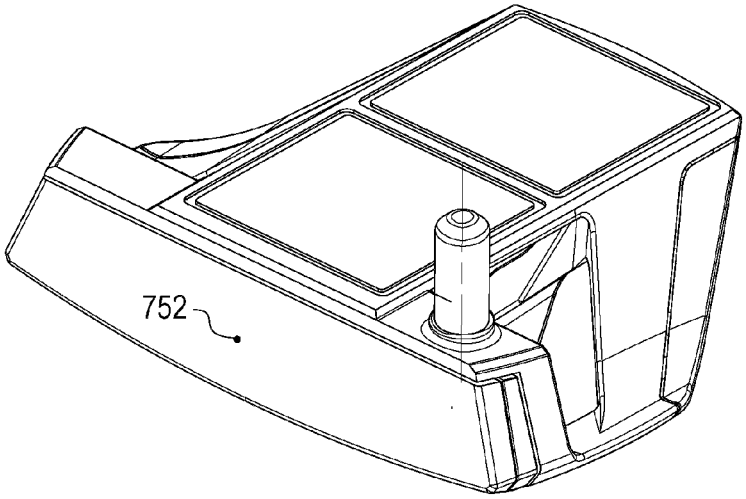

In some embodiments, as shown in FIG. 24, the putter head 300 includes a club head center of gravity 358. The club head is shown in the soled position. A first vertical plane 360 is passes through the forwardmost point of the striking face of the club head and extends in the heel-to-toe direction. The depth of the center of gravity (Dcg) is measured in the forward-to-rearward direction and in a lateral plane (parallel to the ground plane, which coincides with the plane of the paper in FIG. 24), as the shortest distance between the first vertical plane 360 and the center of gravity 358. Preferably, Dcg is no less than 12 mm, more preferably within the range of 12 mm to 18 mm. The club head 300 also has an overall depth (Dch) measured as the lateral distance between the first vertical plane 360 and a second vertical plane 364 that is parallel to the first vertical plane and passes through a rearwardmost point of the club head 300. Dch is preferably no greater than 45 mm, more preferably within the range of 20 mm to 40 mm, and even more preferably between 25 mm and 35 mm. Preferably, the ratio of Dcg to Dch is no less than 0.42, more preferably between about 0.42 and 0.48. Such parameters may improve forgiveness of the club head on off-centered shots.

Additionally, or alternatively, the putter head 300 of FIG. 23(*a*) preferably comprises a mass between about 300 g and about 420 g, more preferably between about 325 g and about 380 g, even more preferably between about 340 g and about 350 g. The putter head 300 further comprises a volume preferably between about 40 cc and 80 cc, more preferably between about 50 cc and 70 cc, even more preferably between about 55 cc and about 65 cc. Additionally, or alternatively, a ratio of volume to mass is preferably no less than 0.14 cc/g, more preferably no less than 0.17 cc/g. Additionally or alternatively, the ratio of volume to mass is no greater than 0.22 cc/g, more preferably no greater than 0.20 cc/g, and even more preferably no greater than 0.18 cc/g.

FIG. 25(*a*)-FIG. 28(*e*) illustrate additional embodiments. In each such embodiment, a putter type golf club head is shown preferably including a main body and a front face insert assembly having dimensions, properties, and any or all other likeness of the front face insert assembly of the embodiments described with regard to FIGS. 1-24. Particularly, with regard to the embodiments of FIGS. 25(*a*)-28(*e*), respectively-described main bodies may be formed by die-casting, as described above as optionally applied to the embodiments of FIGS. 1-24. However, alternatively, the respectively-described main bodies of the embodiments of FIGS. 25(*a*)-28(*e*) may be investment casted, which may minimize potential detraction to the appearance of the club heads due to the relatively high level of porosity associated with, e.g., aluminum or aluminum-alloy in association with die casting.

Referring to FIGS. 25(*a*)-25(*d*), a putter-type golf club head 400 is shown. The club head 400 includes a main body 402 and a face component 404 that includes a first insert 426 and a second insert 428 optionally having dimensions, structure, composition and any and all other likeness of the face components variously described in conjunction with the club head embodiments shown in FIGS. 1-24. The second insert 428 includes a front face and rear face opposite the front face, the front face preferably defining the striking face 430 of the club head 400.

In particular the face component 404 preferably tapers from a minimum front-to-rear thickness tmin to a maximum front-to-rear thickness tmax. Tmin is preferably between about 7 mm and 10 mm, more preferably between about 8 mm and 9 mm, and even more preferably between about 8 mm and 8.5 mm. Tmax is preferably between about 8 mm and 11 mm, more preferably between about 9 mm and 10.5 mm, even more preferably between about 9.25 mm and 10.0 mm, and yet even more preferably substantially equal to about 9.7 mm. Additionally, or alternatively, the ratio, Tmin/Tmax, is preferably between 80% and 95%, more preferably between 82% and 91%, and even more preferably between 85% and 90%. These dimensions may enable the club head 400 to beneficially exhibit the variable impact response as described with regard to similar features of the embodiment shown in FIG. 1.

Additionally, or alternatively, the first insert 426 tapers in thickness in similar manner to that of the embodiment shown in FIG. 1. Specifically, the first insert 416 preferably tapers from a maximum thickness (measured in the front-to-rear direction) to a minimum thickness (measured in the front-to-rear direction). The minimum thickness is preferably located at an uppermost portion of the first insert 416. The minimum thickness is preferably between about 3 mm and 5.5 mm, more preferably between about 3.5 mm and 5 mm, even more preferably between about 4 mm and 4.75 mm. The maximum thickness is preferably between about 4 mm and about 6.5 mm, more preferably between about 5 mm and about 6 mm, even more preferably between about 5.0 mm and 5.75 mm. Additionally, or alternatively, a ratio of the minimum thickness to the maximum thickness is preferably between about 70% and 90%, more preferably between about 75% and about 85%, even more preferably between about 77% and about 83%. These dimensions may enable the club head 400 to beneficially exhibit the variable impact response as described with regard to similar features of the embodiment shown in FIG. 1.

In this embodiment, the main body 402 includes a blade portion 408 and a rear portion 432 extending rearward from the blade portion 408. The rear portion includes a toe mass 403, a heel mass 407 and a cavity 409 located between the toe mass 403 and the heel mass 407. Preferably, the cavity 409 is generally centrally located in the heel-to-toe direction relative to a geometric center 405 of the striking face 430 (see e.g. FIG. 25(*e*)). The cavity 409 defines a heel side wall 409(*a*), a toe side wall 409(*b*) and a bottom wall 409(*c*).

An alignment feature 411 extends upward from the bottom surface 409(*c*) of the cavity 409 and abuts the rear surface 416 of the blade portion 408 of the club head 400. The alignment feature 411 is preferably dimensioned and includes any or all characteristics of like alignment features described in U.S. patent application Ser. No. 14/587,242, herein incorporated by reference in its entirety.

The alignment feature 411 includes a heel side surface 411(*a*), a toe side surface 411(*b*), a top surface 411(*c*) located between the heel side surface 411(*a*) and the toe side surface 411(*b*), and a rear surface 411(*d*). Preferably, the top surface 411(*c*) is arcuate, optionally defining a virtual central axis 413 extending laterally in the generally front-to-rear direction. However, in other embodiments, the top surface 411(*c*) is planar or quasi-planar, or includes any other contour.

Referring specifically to FIG. 25(*b*), to enhance visibility of the top surface of the alignment feature 411, indicia 415 is preferably applied thereto for purposes of generating visual contrast with other portions of the club head 400, preferably portions adjacent to the indicia 415 and/or having the appearance of adjacency when the club head 400 is viewed in top plan. The indicia may comprise a media-blasted region (e.g. sand-blasted region), a chemically etched region, a painted region, a PVD region, an anodized region, an electro-plated region, or a region formed by any other means known to alter the appearance of the top surface 411(*c*) of the alignment feature 411. Preferably, the top surface 411(*c*) of the alignment feature 411 is laser etched. In this manner, no reveal or recess need be formed to contain a paint or other liquid, and manufacturing processes, e.g. additional masking and polishing steps (which steps may be required during a media blasting operation), may be minimized.

Referring particularly to FIG. 25(*c*), the bottom portion 406 includes an exterior bottom surface 414. The bottom surface 414 preferably includes a heel to toe camber and preferably a front to rear camber. The front-to-rear camber is preferably dimensioned to define a radius of curvature of no less than 5 in, more preferably no less than 10 in. In some embodiments, the front-to-rear sole camber defines a substantially constant radius of curvature, or at least defines a constant radius of curvature over a majority of the length of the bottom surface 414. However, in other embodiments, front-to-rear sole camber varies, optionally continuous or in a step-wise manner. In any such embodiment, the sole camber radius of curvature corresponds to the general contour of the bottom surface 414 of the bottom portion 406 thus accounting for minor deviations in the contour of the sole, e.g. small-scale recesses and reveals. By applying a front-to-rear sole camber, relief may be provided in cases of putter strokes that graze closely to a ground surface.

In addition, or alternatively, the sole is preferably contoured (and mass is preferably distributed about the club head 400) such that the club head (when associated with a conventional shaft and enabled to freely rest on a ground surface such that the shaft is oriented at the designated lie angle of the club head) exhibits a face angle that is no greater than 5°, more preferably no less than 3°, and even more preferably within the range of 1-3°. By configuring the club head 400 in this manner, the golfer may be less distracted by natural rotation of a club head upon free placement on a ground surface e.g. during a static alignment process. I.e., the possibly-undesirable tendency of a putter head to "flop open" upon grounding is minimized.

Referring to FIGS. 26(*a*)-26(*f*), a putter-type golf club head 500 is shown. The club head 500 includes a main body 502 and a front face insert component 504 that includes a first insert 526 and a second insert 528 optionally having dimensions, structure, composition and any or all other likeness as in the embodiments shown in FIGS. 1-24. In the embodiments of FIGS. 26(*a*)-26(*f*), the main body 502 includes a blade portion 508, a central elongate portion 510, and a mass ring 511. The blade portion 508 includes a front surface 530 to be secured to the front face component 504 and a rear surface 507 opposite the front surface 530. The central elongate portion 510 extends rearward from the blade portion 508 and includes a top wall 510(*a*), a bottom wall 510(*b*), a central wall 510(*c*), and a rear wall 510(*d*). The top wall 510(*a*) extends generally horizontally when the club head 500 is oriented in a reference position relative a ground plane 568 as shown e.g. in FIG. 26(*b*). The bottom wall 510(*b*) is sloped relative to the virtual ground plane 568 and extends gradually upward rearwardly to associate with the rear wall 510(*d*), communicating between the top wall 510(*a*) and the bottom wall 510(*b*).

The central wall 510(*c*) extends general vertically and generally perpendicular relative to a general plane of a striking face 530 of the club head 500. The central wall 510(*c*) may provide structural support for the putter head 500 and may reduce undesirable low frequency vibrations on impact of the club head 500 with a golf ball. A support wall 513 is further located between the mass ring 511 and the bottom wall 510(*b*) of the central elongate member 510. The support wall 513 may further provide structural support of the club head 500 and may further reduce propagation of undesirable low frequency vibrations upon impact with a golf ball.

The mass ring 511 may serve to relocate discretionary mass further from a center of gravity of the club head 500, increasing moment of inertia of the club head 500, particularly moment of inertia (Izz) measured about a vertical axis passing through the center of gravity when the club head 500 is oriented in the reference position. Alternatively, or in addition, to the support wall 513, a damping system, such as any of the damping systems described above with regard to the embodiments shown in FIGS. 1-24, may be applied to either (or both) of the central elongate portion 510 and the mass ring 511 to further (or substitutably) reduce believed to be undesirable low-frequency vibrations which may emanate based on impact of the golf club head 500 with a golf ball.

A hosel component 524 extends from an upper surface 512 of the main body 502. The hosel component 524 may be integrally formed with the main body 502 or alternatively, may be an aft-attached component that is permanently, or semi-permanently, secured to the main body 502. Referring specifically to FIG. 26(*b*), the hosel component comprises a positive-type hosel component and may be adapted to snugly fit within an interior bore of a conventional golf shaft. Alternative hosel configurations are contemplated including those including an internal bore for receipt of a golf shaft therewithin, or "hosel-less" type club heads in which a portion of the main body is bored-through to enable receipt of a conventional golf shaft.

As shown, the hosel component 524 defines a longitudinal axis 509. The longitudinal axis 509 is preferably canted forward. Particularly, when the club head 500 is oriented in the reference position relative to the virtual ground plane 568, as projected in a vertical plane perpendicular to the general plane of the striking face 530, the longitudinal axis 509 forms an angle ω relative to vertical. Preferably, the angle ω is no less than 1°, more preferably between 2° and 10°, even more preferably between 4° and 8°, and even yet more preferably substantially equal to about 6°.

The hosel component 524 may include a boss 524(*a*) and a shoulder element 524(*b*) that is located between the boss element 524(*a*) and the main body 502. The boss 524(*b*) preferably includes an upper abutment surface 524(*c*) that generally lies in a plane that is perpendicular to the longitudinal axis 509. In this manner, a conventional golf shaft may be tip-cut squarely and still robustly contact the abutment surface 524(*c*), promoting secure engagement.

By canting the hosel component 524 in this manner, a shaft having a bend, or double-bend, could be applied while conforming to the USGA regulations regarding shafts as described above. The forward-canting nature of the hosel component 524 enables deviation in shaft longitudinal path at a point closer to the tip end of the shaft, as compared with a hosel component that is no so canted. The forward-canting nature of the hosel component 524 may be further desirable in view of the relatively high thickness of the face component 504, as described above with regard to the embodiments of FIGS. 1-24. As the thickness of the insert component 504 is high, a thin flange 550 preferably extends above the insert component 504, dimensioned as with regard to the embodiments of FIG. 1-24.

The combination of thick front insert component 504 and thin flange 550 may result in a reduced-stability heel-side region of the upper surface of the main body 502 where a shaft may typically be secured, e.g. due to shaft torsion being centered about an axis that does not extend into a relatively solid portion of the main body 502. Canting the hosel component 524 in the manner described above enables the centering of shaft torque about an axis extending through a more solid portion of the main body 502 of the club head 500, increasing structural integrity.

In some embodiments, the various surfaces of the club head 500 are CNC-machined, particular interfaces between the front insert component 504 and the main body to ensure predetermined tolerances are met and/or to correct for misalignment and tolerances in manufacturing. Referring specifically to FIG. 26(*c*), alternatively, or in addition, a thin bevel 531 at least partially, and preferably entirely, circumscribes the striking face 530. The bevel 531 may be formed by milling, preferably using a diamond-coated mill bit. The bevel 531 may, provided reflectance of light, enhance the visibility of the bounds of the striking face to a golfer in the midst of play, improving alignment and reducing mis-hits.

Referring to FIG. 27(*a*)-FIG. 27(*f*), a putter-type golf club head 600 is shown including a main body 602 and a front face insert assembly 604 having dimensions, properties, and any or all other likeness of the front face insert component of any of the embodiments described with regard to FIGS. 1-24. The insert assembly 604 defines a putter head striking face 630.

In this embodiment, the club head 600 includes a blade portion 608 and a rear portion 632 extending rearward from the blade portion 608. The rear portion 632 includes a toe mass 603, a heel mass 607, and a cavity 609 located generally between the toe mass 603 and the heel mass 607. Preferably, the cavity 609 is generally centrally located in the heel-to-toe direction relative to a geometric center 605 of the striking face 630.

The toe mass 603 preferably defines a toe-side recess 611 that preferably extends the majority of the thickness of the toe mass 603, and more preferably extends entirely through the toe mass 603. Similarly, the heel mass 607 preferably defines a heel-side recess 613 that preferably extends the majority of the thickness of the heel mass 607, and more preferably extends entirely through the heel mass 607. In some embodiments, the heel-side recess 613 and the toe-side recess 611 are similar in shape, particularly when viewed vertically from above and/or as the heel-side recess 613 and the toe-side recesses 611 are projected in a plane parallel to the ground plane 668, when the club head 600 is oriented in the reference position. In some embodiments, the heel-side recess 613 and the toe-side recess 611 are mirror-image in shape, particularly when viewed vertically from above and/or as the heel-side recess 613 and the toe-side recesses 611 are projected in a plane parallel to the ground plane 668, when the club head 600 is oriented in the reference position. These configurations may improve the golfer's ability to correctly align the putter head 600 with a golf ball in the midst of play, during either a static alignment process or, dynamically, during a swing.

The heel mass 607 and toe mass 603 may serve to relocate discretionary mass further from a center of gravity of the club head 600, increasing moment of inertia of the club head 600, particularly moment of inertia (Izz) measured about a vertical axis passing through the center of gravity when the club head 600 is oriented in the reference position.

An alignment feature 615 is secured to the blade portion 608 of the club head 600 and extends rearward therefrom. In this particular embodiment, the alignment feature 615 comprises a plate-like wall 621 that defines a generally planar upper surface 617 and, optionally, a generally planar bottom surface 625. The upper surface 617 preferably generally defines a plane that is parallel to the ground plane 668, when the club head 600 is oriented in the reference position. Indicia 619 is located on the upper surface 617 providing an indicator that may be intended to assist golfer in aligning the club head 600 with a golf ball. In some embodiments, the indicia 619 comprises a shallow groove or reveal in the form of a rectangular shape, more preferably a square shape, when viewed vertically from above the club head 600. However, other shapes and configurations are possible, including those that include indicium that are offset vertically and combine to form a complete shape when properly viewed vertically from above. Alternative or additional configurations for alignment features may be selected from those described in U.S. patent application Ser. Nos. 14/166,289 and 14/311,047, herein incorporated by reference in their entirety.

Preferably the wall 621 is further supported by a generally vertically-extending support wall 623 that couples the wall 621 to the upper surface of the rear portion. Preferably, support wall 623 is generally centrally located in the heel to toe direction, i.e. generally aligned with the geometric center 605 of the striking face 630 in the heel to toe direction. However, the support wall 623 may alternatively be offset from the geometric center 605 in the heel to toe direction. In some embodiments, plural vertical support walls secure the wall 621 to the upper surface of the rear portion 632. In such cases, preferably, a first such support wall is located heelward of the geometric center of the striking face of the club head and a second support wall is located toeward of the geometric center of the striking face. The golf club head 600 preferably includes sole camber configured as described with regard to the embodiments of FIG. 25(*a*)-25(*d*). Additionally, or alternatively, the golf club head 600 preferably includes a hosel component being configured in any of the manners described with regard to the embodiments shown in FIGS. 26(*a*)-25(*c*).

Referring to FIG. 28(*a*)-FIG. 28(*g*), a putter-type golf club head 700 is shown including a main body 702 and a front face insert assembly 704 having dimensions, properties, and any or all other likeness of the front face insert component of any of the embodiments described with regard to FIGS. 1-24. The insert assembly 704 defines a putter head striking face 730. The main body 702 includes a blade portion 708 having a top line 738, a front surface (not shown) to which the front insert assembly 704 is secured, and a rear surface 716 opposite the front surface.

A central elongate member 710 is associated with the rear surface 716 of the blade portion 708. The central elongate member 710 may include an upper wall 721 having an upper wall top surface 717 that generally defines a planar surface that is generally parallel to the ground plane 768. The top surface 717 of the upper wall 721 of the central elongate member may include thereon alignment indicia 719. Indicia 719 may provide an indicator intended to assist a golfer in aligning the club head 700 with a golf ball. In some embodiments, the indicia 719 comprises a single shallow groove or reveal in the form of a rectangular shape, more preferably a square shape, when viewed vertically from above the club head 600. Alternatively, and as shown particularly in FIG. 28(*b*), in some embodiments, the indicia 719 comprises plural, e.g. two, shallow grooves or reveals in the form of rectangular shapes, more preferably square shapes, when viewed vertically from above the club head 700. However, other indicia shapes and configurations are possible, including those that include indicium that are offset vertically and combine to form a complete shape when properly viewed vertically from above. Alternative or additional configurations for alignment features may be selected from those described in U.S. patent application Ser. Nos. 14/166,289 and 14/311,047, incorporated by reference in their entirety.

The central elongate member 710 further includes a lower wall 727 that extends from the rear surface 716 of the blade portion 730 and couples with the upper wall 721 at a rear surface 729 of the club head 700. The bottom (lower) wall 727 include a bottom wall upper surface 727(*b*) and a bottom wall lower surface 727(*a*), the bottom wall lower surface 727(*a*) defining a generally planer surface. However, the bottom wall lower surface 727(*a*) optionally includes, e.g., small-scale recesses or reveals, and/or heel-to-toe camber e.g. having aspects described with regard to the heel-to-toe camber of the club head embodiments of FIGS. 25(*a*)-25(*d*), and/or front to rear camber e.g. having aspects described with regard to the heel to toe camber of the club head embodiments of FIGS. 25(*a*)-25(*d*).

In some embodiments, the lower wall 727 generally takes the same form or shape as the upper wall 721, such that the lower wall 727 may not be visible when viewed vertically from above. However, in other embodiments, such as the embodiment shown particularly in FIGS. 28(*b*) and 28(*c*), the shape of the lower wall 727 differs from the shape of the upper wall 721. Specifically, in some embodiments, the upper wall 721 forms a generally rectangular shape elongate in the front-to-rear direction, the rearmost edge 721(*a*) optionally following an arcuate path (see e.g. FIG. 28(*b*)). In contrast, as shown, the lower wall 727 may have a forward portion 729 that forms a generally triangular shape. The lower wall 727 further comprises a rearward portion 731 having a generally rectangular shape, also elongate generally in the front-to-rear direction. The forward portion 729 of the lower wall 727 preferable tapers in width toward the rearward portion 731. The rearward portion 731 also preferably has a width measured in the heel-to-toe direction that is less than a width of the upper wall 721 also measured in a heel-to-toe direction.

In some embodiments, a vertical support wall 733 (see e.g. FIG. 28(*d*)) joins that upper wall 721 with the lower wall 727 and, optionally, joins with the rear surface 716 of the blade portion 730 of the main body 702. The support wall 733 preferably extends generally vertically and in the front-to-rear direction. Preferably, the support wall 733 is located in a generally central heel-to-toe location, i.e. generally aligned with a geometric center 752 of the striking face 730 in the heel to toe direction. The support wall 733 may extend the entire longitudinal length of the central elongate member 710. However, in some embodiments, the support wall 733 terminates at rearwardmost end that is forward of the rearwardmost end of the central elongate member 710. However, in some embodiments, a support wall is offset from this central heel-to-toe location or extends generally in a heel-to-toe direction instead of in a front-to-rear direction. In some embodiments, plural, e.g. two, support walls adjoin the upper wall 721 and the lower wall 727. In such cases, one such support wall is located heelward of the geometric center 752 of the striking wall and one such support wall is located toeward of the geometric center 752 of the striking face 730. However, other configurations are also contemplated.

The main body 702 further includes a heel arm 711 that extends rearwardly from the rear surface 716 of the blade portion 730 proximate the heel portion 713 of the club head 700 and a toe arm 712 that extends rearwardly from the rear surface 716 of the blade portion 730 proximate the toe portion 715 of the club head 700. Preferably the heel arm 711 and the toe arm 712 are symmetric about a vertical plane perpendicular to the general plane of the striking face 730. Further, the heel arm 711 and the toe arm 712, in this embodiment, preferably converge rearwardly to adjoin with the central elongate member 710. The heel arm 711 preferably includes a heel arm forward portion 711(*a*) and a heel arm rearward portion 711(*b*). The toe arm 712 preferably includes a toe arm forward portion 712(*a*) and a toe arm rearward portion 712(*b*). Each of the heel arm forward portion 711(*a*) and the toe arm forward portion 712(*a*) comprise generally planar walls that are generally planar in a plane generally parallel to the ground plane 768.

Each of the heel arm rearward portion 711(*b*) and the toe arm rearward portion 712(*b*) adjoin the respective heel arm forward portion 711(*a*) and the toe arm forward portion 712(*a*) with the central elongate member 710. Also, each of the heel arm rearward portion 711(*b*) and the toe arm rearward portion 712(*b*) comprise generally planar walls that generally extend about planes that are inclined relative to the ground plane. Particularly, each such wall is preferably inclined in a vertical plane that extends in the heel to toe direction. In such a plane, each of the heel arm rearward portion 711(*b*) and the toe arm rearward portion 712(*b*) are inclined relative to the ground plane by an angle between 10° and 60°, more preferably between about 30° and 55°, and even more preferably between about 40° and 50°. These configurations balance: (a) the redistribution of mass away from a center of gravity of the club head, thereby increasing club head moment of inertia; (b) structural integrity of the club head 700, particularly the central elongate member 710; and (c) minimization of the propagation of believed to be undesirable low frequency vibrations upon impact with a golf ball.

While various features have been described in conjunction with the examples outlined above, various alternatives, modifications, variations, and/or improvements of those features and/or examples may be possible. For example, one of ordinary skill in art may appreciate that any association with one or more aspects to putter-type club heads may be similarly applied to, and be similarly advantageous in, wood-type club heads, hollow-type club heads, iron-type club heads, wedge type club heads, and/or hybrid type club heads. Accordingly, the examples, as set forth above, are intended to be only illustrative. Various changes may be made without departing from the broad spirit and scope of the underlying principles.

What is claimed is:

1. A putter-type golf club head comprising:

a main body having a body forward end and a first flange having a first flange forward end defined by a front surface of the first flange, a rearward end opposite the forward end, a bottom portion, a top portion opposite the bottom portion that is at least partially formed by the first flange, and a male-type hosel component defining a longitudinal axis that is forwardly canted relative to vertical;

a face component secured to the body forward end of the main body, the face component including:

a first element formed of a resilient material and a second element formed of a rigid material and contacting the first element, a front surface defined by the second element, a rear surface opposite the front surface and at least partially defined by the first element, and a second flange extending rearward from the first element;

a sole partially defined by the main body bottom portion and partially defined by a bottom surface of the second flange; and a striking face generally defining a virtual striking face plane and being at least partially formed by the face component.

2. The golf club head of claim 1, wherein the first element has a thickness that gradually increases in the top-to-bottom direction.

3. The golf club head of claim 1, wherein the longitudinal axis, as projected into a virtual vertical plane perpendicular to the striking face plane, forms an angle with the vertical of between about 2° and about 10°.

4. The golf club head of claim 1, wherein the first flange extends above the face component such that the face component is not visible when the golf club head is in an address position.

5. The golf club head of claim 4, wherein the first flange extends forwardly from the face component by a distance of no less than 0.1 mm.

6. The golf club head of claim 4, wherein a portion of the first flange has a thickness no greater than 0.1 inches.

7. The golf club head of claim 1, wherein the face component comprises a maximum thickness no less than 4.0 mm.

8. The golf club head of claim 1, wherein the second element is secured only to the first element.

9. The golf club head of claim 1, wherein the first element comprises a forward surface, a rearward surface opposite the forward surface, a heel surface, a toe surface opposite the heel surface, a top surface, and a bottom surface opposite the top surface, wherein at least a portion of at least one of the heel surface, the toe surface, and the bottom surface are visually exposed.

10. A putter-type golf club head that, when oriented in a reference position, comprises:

a main body having a front surface, a rear surface opposite the front surface, a bottom surface, a top surface opposite the bottom portion, and a flange extending forwardly from the front surface;

a face component secured to the front surface of the main body such that the flange extends over the face component and forwardly of the face component by no less than 0.1 mm, the face component including a first element formed of a resilient material and a second element formed of a rigid material and secured to the first element; and a striking face generally defining a virtual striking face plane and being at least partially formed by the face component.

11. The golf club head of claim 10, wherein the main body further comprises a male-type hosel component defining a longitudinal axis that is forwardly canted relative to vertical, such that the longitudinal axis, when projected into a virtual vertical plane perpendicular to the striking face plane, forms an angle with the vertical of between about 2° and about 10°.

12. The golf club head of claim 10, wherein a portion of the flange has a thickness no greater than 0.1 inches.

13. The golf club head of claim 10, wherein the face component comprises a maximum thickness no less than 4.0 mm.

14. The golf club head of claim 10, wherein the second element is secured only to the first element.

* * * * *